US005962176A

United States Patent [19]

Ohno et al.

[11] Patent Number: 5,962,176

[45] **Date of Patent: *Oct. 5, 1999**

[54] TONER FOR DEVELOPING ELECTROSTATIC IMAGE, IMAGE FORMING METHOD AND PROCESS-CARTRIDGE

[75] Inventors: Manabu Ohno, Funabashi; Yukari Ishibashi, Inagi; Nobuyuki Okubo, Yokohama; Shunji Suzuki, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,350

[22] Filed: Jan. 30, 1997

Related U.S. Application Data

[63] Continuation of application No. 08/636,824, Apr. 23, 1996, abandoned, which is a continuation of application No. 08/361,236, Dec. 21, 1994, abandoned.

[30] Foreign Application Priority Data

Dec. 24, 1993 [JP] Japan ..... 5-345937

[51] Int. Cl.[6] ..... G03G 9/087

[52] U.S. Cl. ..... 430/109; 430/110; 430/111

[58] Field of Search ..... 430/109, 110, 430/111

[56] References Cited

U.S. PATENT DOCUMENTS

| | | | |
|---|---|---|---|
| 2,297,691 | 10/1942 | Carlson . | |
| 3,666,363 | 5/1972 | Tanaka et al. . | |
| 4,071,361 | 1/1978 | Marushima . | |
| 4,206,064 | 6/1980 | Kiuchi et al. | 430/106 |

(List continued on next page.)

FOREIGN PATENT DOCUMENTS

| | | |
|---|---|---|
| 2098233 | 12/1993 | Canada . |
| 0295901 | 12/1988 | European Pat. Off. . |

(List continued on next page.)

OTHER PUBLICATIONS

Sadao Mori, "Size–Exclsusion Chromatography", First Print, Published Dec. 10, 1991, by Kyoritsu Shuppan K.K. pp. 111–114.

Kuo et al., "Evaluation and Application . . . Chain Branching", 1989 Int'l GPC Symposium, Oct. 1–4, 1989, publ. by Waters Co. Div. of The Glidden Co.

Letot et al., J.Liquid Chromatography, vol. 3, pp. 427–438 (1980).

*Primary Examiner*—Hoa Van Le
*Attorney, Agent, or Firm*—Fitzpatrick, Cella, Harper & Scinto

[57] ABSTRACT

A toner for developing an electrostatic image is constituted by a composition containing a binder resin component and a coloring agent, wherein the binder resin component contains a low-molecular weight component having a molecular weight of at most $5\times10^4$ and a branching index g' of below 1. The low-molecular weight polymer component is preferably obtained by polymerizing a second monomer in mixture with a prepolymer in the presence of a polymerization initiator comprising a peroxide having a functional group of:

and mixed with a high-molecular weight polymer component obtained by polymerization in the presence of a polyfunctional polymerization initiator, and a low-molecular weight wax. The resultant toner is characterized by a good balance between the fixability and anti-offset characteristic.

23 Claims, 6 Drawing Sheets

U.S. PATENT DOCUMENTS

| | | | |
|---|---|---|---|
| 4,404,271 | 9/1983 | Kawagishi et al. | 430/110 |
| 4,460,750 | 7/1984 | Thiersault et al. | 525/333.8 |
| 4,499,168 | 2/1985 | Mitsuhashi | 430/99 |
| 4,908,290 | 3/1990 | Watanabe et al. | 430/106.6 |
| 4,916,198 | 4/1990 | Scheve et al. | 526/351 |
| 5,126,224 | 6/1992 | Hyosu et al. | 430/106.6 |
| 5,149,941 | 9/1992 | Hirabayashi et al. | 219/216 |
| 5,153,377 | 10/1992 | Kuwashima et al. | 118/657 |
| 5,185,405 | 2/1993 | Nishida | 525/228 |
| 5,298,354 | 3/1994 | Matsunaga et al. | 430/110 |
| 5,342,722 | 8/1994 | Ito et al. | 430/111 |
| 5,362,595 | 11/1994 | Hirayama et al. | 430/111 |
| 5,364,723 | 11/1994 | Georges et al. | 430/110 |
| 5,389,483 | 2/1995 | Kawasaki et al. | 430/110 |
| 5,407,776 | 4/1995 | Kanbayashi et al. | 430/110 |
| 5,422,218 | 6/1995 | Tong | 430/110 |
| 5,427,884 | 6/1995 | Ohtani et al. | 430/110 |
| 5,447,813 | 9/1995 | Hagiwara et al. | 430/106.6 |

FOREIGN PATENT DOCUMENTS

| | | |
|---|---|---|
| 0438181 | 7/1991 | European Pat. Off. . |
| 0575891 | 12/1993 | European Pat. Off. . |
| 55-42752 | 11/1980 | Japan . |
| 56-16144 | 2/1981 | Japan . |
| 57-52574 | 3/1982 | Japan . |
| 58-41508 | 9/1983 | Japan . |
| 58-215659 | 12/1983 | Japan . |
| 59-7385 | 2/1984 | Japan . |
| 60-252361 | 12/1985 | Japan . |
| 60-252362 | 12/1985 | Japan . |
| 61-114246 | 5/1986 | Japan . |
| 62-9356 | 1/1987 | Japan . |
| 63-127254 | 5/1988 | Japan . |
| 63-313182 | 12/1988 | Japan . |
| 1-187582 | 7/1989 | Japan . |
| 2-235069 | 9/1990 | Japan . |
| 2-272459 | 11/1990 | Japan . |
| 3-26831 | 2/1991 | Japan . |
| 3-72505 | 3/1991 | Japan . |

TONER FOR DEVELOPING ELECTROSTATIC IMAGE, IMAGE FORMING METHOD AND PROCESS-CARTRIDGE

This application is a continuation of application Ser. No. 08/636,824, filed Apr. 23, 1996, now abandoned, which in turn, is a continuation of application Ser. No. 08/361,236 filed Dec. 21, 1994, now abandoned.

FIELD OF THE INVENTION AND RELATED ART

The present invention relates to a toner for developing electrostatic images used in image forming methods, such as electrophotography, electrostatic recording and magnetic recording; an image forming method using the toner; and also a process-cartridge including the toner. The present invention relates to a resin composition suitable as a binder resin component for constituting such a toner, and a process for producing such a resin composition.

Hitherto, a large number of electrophoto-graphic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating, pressing, or heating and pressing, or with solvent vapor to obtain a copy. The residual toner on the photosensitive member without being transferred is cleaned, as desired by various methods, and then the above steps are repeated.

In recent years, such an electrophotographic image forming apparatus has been required to satisfy serious requirements regarding a smaller size, a smaller weight, a higher speed and a higher reliability, and accordingly a toner is required to show higher performances. For example, regarding the step of fixing a toner image onto a sheet such as paper, various methods and apparatus have been developed. Among these, the most popular is the hot pressure fixing system using hot rollers. In the heat-fixing system using such hot rollers, a sheet carrying a toner image to be fixed (hereinafter called "fixation sheet") is passed, while the surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine.

However, the above-mentioned hot roller fixation system frequently used heretofore has left the following problems.

(1) There is required a so-called waiting time within which image formation is not allowed, until the hot rollers reach a prescribed temperature.

(2) It is necessary to keep the hot rollers at an optimum temperature so as to prevent fixation failure and offsetting of a toner onto the hot rollers caused by a change in hot roller temperature due to passing of recording materials or sheets (i.e., fixation sheets) or other external factors. For this purpose, it is necessary to increase the heat capacity of the hot rollers or the heating member, and this requires a large electrical power consumption and also causes a temperature increase in the image forming apparatus.

(3) As the rollers are at a high temperature, the toner on the recording sheets having passed and discharged out of the rollers is cooled slowly to retain a high viscosity for a substantial time, so that the toner is liable to cause offset or winding of the recording sheets about the rollers leading to paper jamming.

Japanese Laid-Open Patent Application (JP-A) 63-313182 (corr. to EP-A 0295901) has proposed an image forming apparatus of a short waiting time and a low electric power consumption including a fixing apparatus wherein a toner image on a recording sheet is heated via a moving heat-resistant sheet by a heat-generating member of a low heat capacity energized and heated by pulse current conduction, thereby to be fixed onto the recording sheet. Further, JP-A 1-187582 has proposed a fixing apparatus for heating a toner image via a heat-resistant sheet to fix the toner image onto a recording sheet, wherein the heat-resistant sheet has a heat-resistant layer and a release layer or a low-resistivity layer so as to effectively prevent the offset phenomenon.

However, the realization of excellent fixation of toner images onto recording sheets and prevention of offset as well as a short waiting time and a low power consumption, should owe much to the characteristics of a toner used in addition to the fixing apparatus as mentioned above.

Based on a concept of providing a toner per se with good fixability and anti-offset characteristic, there have been hitherto proposed (i) to use a toner binder resin having two peaks in its molecular weight distribution, and (ii) to add a low-molecular weight polyolefin polymer as represented by a low-molecular weight wax into a toner.

Examples of the proposal (i) may include those disclosed in JP-A 56-16144, JP-A 2-235069, JP-A 63-127254, JP-A 3-26831, JP-A 62-9356 and JP-A 3- 72505. Examples of the proposal (ii) may include those disclosed in JP-A 52-3304, JP-A 52-3305, JP-A 57-52574, JP-A 58-215659, JP-A 60-217366, JP-A 60 -252361, and JP-A 60-252362.

However, mere use of a binder resin having two peaks in the molecular weight distribution or mere incorporation of a certain release agent in a toner may provide some improvements in fixability and anti-offset characteristic but can be accompanied with other difficulties, such as un-uniformity of binder component in the toner, obstruction to dispersion of other components such as wax, and localization or isolation of particular components, leading to soiling of images such as fog, and melt-sticking or filming onto a photosensitive member, etc., in some cases.

It has been also disclosed to use a multi-functional initiator to provide a binder resin having two peaks of which the higher molecular weight is provided with a larger molecular weight in JP-A 2-272459 and JP-A 3-72505. In order to provide a better fixability at a low temperature and a better anti-offset characteristic at a high temperature, however, it is necessary to provide a binder resin having a wider molecular weight distribution. If this is applied to a binder resin having two peaks, the segregation between the low-molecular weight component and the high-molecular weight component is promoted to provide a worse mutual solubility therebetween, thereby being liable to cause the above-mentioned serious difficulties.

When the melt-kneading conditions in toner production are accordingly enhanced in order to improve the mutual solubility and dispersibility of the toner components, the molecular weight of the toner binder resin can be lowered because of the severance of molecular chains due to the kneading, etc., thus providing a worse anti-offset characteristic, particularly at a high temperature, in some cases. When a large quantity of wax is incorporated in order to provide a sufficient anti-offset characteristic, it is possible to provide a worse anti-blocking characteristic and a worse dispersibility of wax, thus soiling the developer-carrying surfaces of a carrier or a sleeve to result in practical problems, such as inferior image quality.

In contrast thereto, JP-A 61-114246 has proposed to graft a vinyl monomer onto a high-molecular weight polymer component having a number-average molecular weight of at least $3\times10^4$ to provide a resin having a molecular weight distribution intended to a higher molecular weight side, thereby improving the anti-offset characteristic. Such a binder resin can provide a somewhat broadened molecular weight distribution while retaining a relatively good mutual solubility, but the effect thereof can be half diminished because the high-molecular weight side component is preferentially severed under a shearing force exerted during the melt-kneading for toner production. Particularly, when the technique is applied to production of a magnetic toner wherein magnetic fine particles having a high specific gravity have to be uniformly dispersed, it becomes very difficult to ensure the improvement in anti-offset characteristic and good developing performance in combination. For example, the use of a resin having a relatively large molecular weight as large as a number-average molecular weight in excess of $3\times10^4$ can lower the graft ratio to result in by-products providing a developer with unstable chargeability, thereby causing a difficulty of combination with an image forming means and other difficulties, such as toner fog on a white background and cleaning failure when a fine particle size of toner is used in order to provide higher quality developed images.

Further, various performances as mentioned above required of a toner are mutually contradictory in many cases and satisfaction of those performances is still more being required in these years.

SUMMARY OF THE INVENTION

A generic object of the present invention is to provide a toner for developing electrostatic images having solved the above-mentioned problems of the prior art, and an image forming method and a process cartridge using such a toner.

A more specific object of the present invention is to provide a toner for developing electrostatic images having excellent heat-fixability.

Another object of the present invention is to provide a toner for developing electrostatic images having an excellent anti-offset characteristic.

Another object of the present invention is to provide a toner for developing electrostatic images having excellent continuous image forming characteristics for a large number of sheets.

A further object of the present invention is to provide an image forming method and a process-cartridge using such a toner as described above.

A still further object of the present invention is to provide a resin composition suitable for producing such a toner and a process for producing such a resin composition.

According to the present invention, there is provided a toner for developing an electrostatic image, comprising a composition containing a binder resin component and a coloring agent, wherein the binder resin component contains a low-molecular weight component having a molecular weight of at most $5\times10^4$ and a branching index g' of below 1.

According to another aspect of the present invention, there is provided an image forming method, comprising:

a charging step of causing a charging member supplied with a voltage to contact a member to be charged to charge the member to be charged, a step of forming an electrostatic image on the charged member to be charged, a developing step of developing the electrostatic image to form a toner image on the member to be charged, a transfer step of transferring the toner image on the member to be charged onto a transfer material, optionally via an intermediate transfer member, and a fixation step of heat-fixing the toner image onto the transfer material, wherein the toner comprises a composition containing a binder resin component and a coloring agent, wherein the binder resin component contains a low-molecular weight component having a molecular weight of at most $5\times10^4$ and a branching index g' of below 1.

According to still another aspect of the present invention, there is provided a process-cartridge, comprising at least a developing means and a photosensitive member, wherein the developing means and the photosensitive member is integrated into a cartridge which is detachably mountable to a main body of an image forming apparatus, the developing means contains a toner, and the toner comprises a composition containing a binder resin component and a coloring agent, wherein the binder resin component contains a low-molecular weight component having a molecular weight of at most $5\times10^4$ and a branching index g' of below 1.

According to a further aspect of the present invention, there is provided a resin composition comprising a mixture of a low-molecular weight polymer component and a high-molecular weight polymer component, wherein the low-molecular weight polymer component has a molecular weight of at most $5\times10^4$ and a Zimm Stockmayer's branching index of below 1.

According to a still further aspect of the present invention, there is provided a process for producing a resin composition containing a mixture of a low-molecular weight polymer component and a high-molecular weight polymer component, comprising: preparing the low-molecular weight polymer component having a molecular weight of at most $5\times10^4$ by polymerizing a monomer in the presence of a polymerization initiator comprising a peroxide having a functional group of:

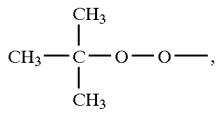

the low-molecular weight polymer component having a branching index g' of below 1.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
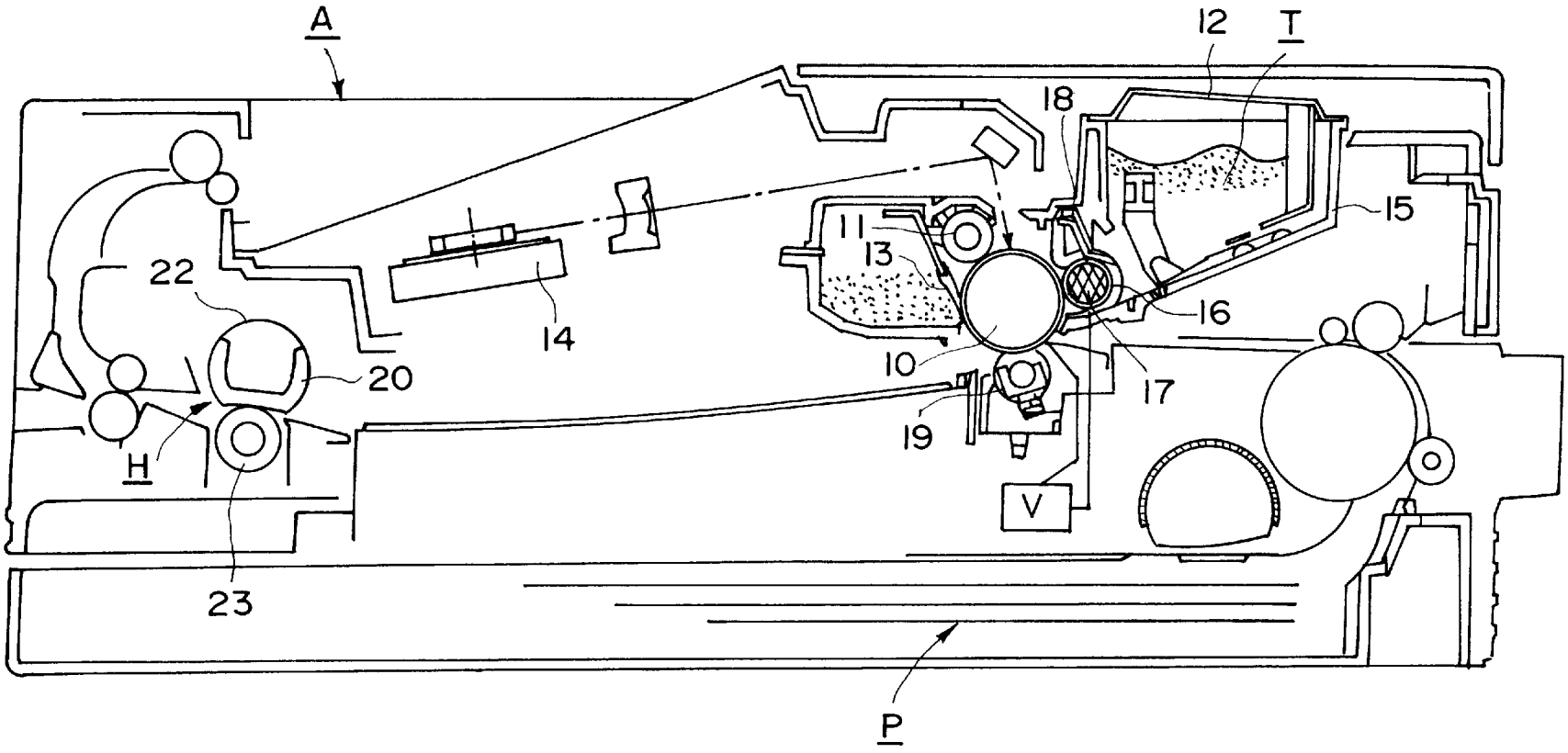
FIG. 1 is a schematic illustration of an image forming apparatus used in Examples of the present invention.

In the present invention, we have succeeded in providing a toner which shows a good balance between a low-temperature fixability and anti-offset characteristic, a good developing performance and a high degree of matching with an image forming apparatus. The improvements may be attributable to an increase in mobility of polymer molecules due to increased free terminals of polymers, and an increase in polymer elasticity due to the branched structure.

The resin composition constituting the toner according to the present invention may preferably be substantially free from THF-insoluble content. More specifically, it is preferred that the composition does not contain more than 5 wt. %, preferably more than 3 wt. %, of a THF-insoluble content.

The "THF-insoluble content" referred to herein means a polymer component (substantially, a crosslinked polymer) which is insoluble in a solvent THF (tetrahydrofuran) within a resin composition constituting a toner, and thus may be used as a parameter indicating the degree of crosslinking of a resin composition containing a crosslinked component. The THF-insoluble content may be defined as a value measured in the following manner.

About 0.5–1.0 g of a toner sample or a resin composition sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor. The extraction is performed for 6 hours. The soluble content extracted with the solvent is dried first by evaporation of the solvent and then by vacuum drying at 100° C. for several hours, and weighed (at $W_2$ g). The components other than the resin component, such as a magnetic material and pigment, are weighed or determined (at $W_3$ g). The THF-insoluble content (wt. %) is calculated as $[(W_1-(W_3+W_2))/(W_1-W_3)]\times 100$.

A THF-insoluble content exceeding 5 wt. % makes it difficult to accomplish a good low-temperature fixability.

The binder resin component in the toner according to the present invention contains a low-molecular weight polymer having a molecular weight of at most $5\times10^4$ and a branching index g' of below 1. The low-molecular weight polymer may preferably have a branching index g' of at most 0.97, more preferably at most 0.95, further preferably at most 0.93. The Zimm Stockmayer's branching index g of a branch polymer may be calculated from a ratio $[\eta_{branch}]/[\eta_{linear}]$ between the intrinsic viscosity $[\eta_{branch}]$ of the branch polymer and the intrinsic viscosity $[\eta_{linear}]$ of a linear polymer having a molecular weight distribution identical to that of the branch polymer (See Sadao Mori: "Size-Exclusion Chomatography" (First Print (published Dec. 10, 1991, from Kyoritsu Shuppan K.K.) pp. 111–114). On the other hand, the branching index g' of a low-molecular weight polymer having a molecular weight of at most $5\times10^4$ referred to herein is based on values measured with reference to C. Kuo, T. Provder & M. E. Koehler, "Evaluation and Application of a Commercial Single Capillary Viscometer System for the Characterization of Molecular Weight Distribution and Polymer Chain Branching" Presented at the 1989 International GPC Symposium, Oct. 1–4, 1988, (Published from Waters Co.); J. Lesec and C. Quiveron, Anulusis, 4, 399 (1976); and L. Letot, J. Lesec and C. Quiveron, J. Lig. Chromotog. 3, 407(1982), e.g., under the following conditions:

Apparatus: GPC-150CV (mfd. by Waters Co.)

Column: two columns of GMH-H and GMH-L (mfd. by Toso K.K.)

Temp.: 30° C.

Solvent: THF

Flow rate: 1.0 ml/min.

Sample: A sample at a concentration of 0.05–0.5 wt. % is injected in a volume of 0.2 ml.

The values of the Mark-Houwink parameters K and $\alpha$, molecular weight distribution and viscosity of a polymer sample are measured by using the above apparatus, a refractometer and a single capillary viscometer and also GPCV Software. More specific procedure will now be described with reference to FIG. 7.

First, the GPC molecular weight distribution of a sample and the viscosities $[\eta_{branch}]$ of the respective molecular weight fractions are measured according to GPC and by using the single capillary viscometer, respectively. Now, the peak intensity of a main peak on a GPC chromatogram is assumed to be 100%, and the branching index g' of low-molecular weight side components (indicated by a hatched portion) having an intensity of at most 20% is assumed to be 1.

From the molecular weight distribution and viscosity data of fractions (preferably at least 5 fractions each taken at a retention time interval of, e.g., 20 sec.) having different molecular weights (M) in the hatched portion, the parameters K and $\alpha$ in the equation:

$$g'(M)=[\eta_{branch}](M)/[\eta_{linear}](M)=[\eta_{branch}](M)/K_{linearr}\times M^{\alpha linear},$$

are determined according to the least square method. In case where no measured molecular weight point (fraction) is exactly found at a peak intensity of 20%, a measured point closer to a peak intensity of 20% is taken to define a hatched portion as shown in FIG. 7 to obtain parameters K and $\alpha$.

Figure 7:
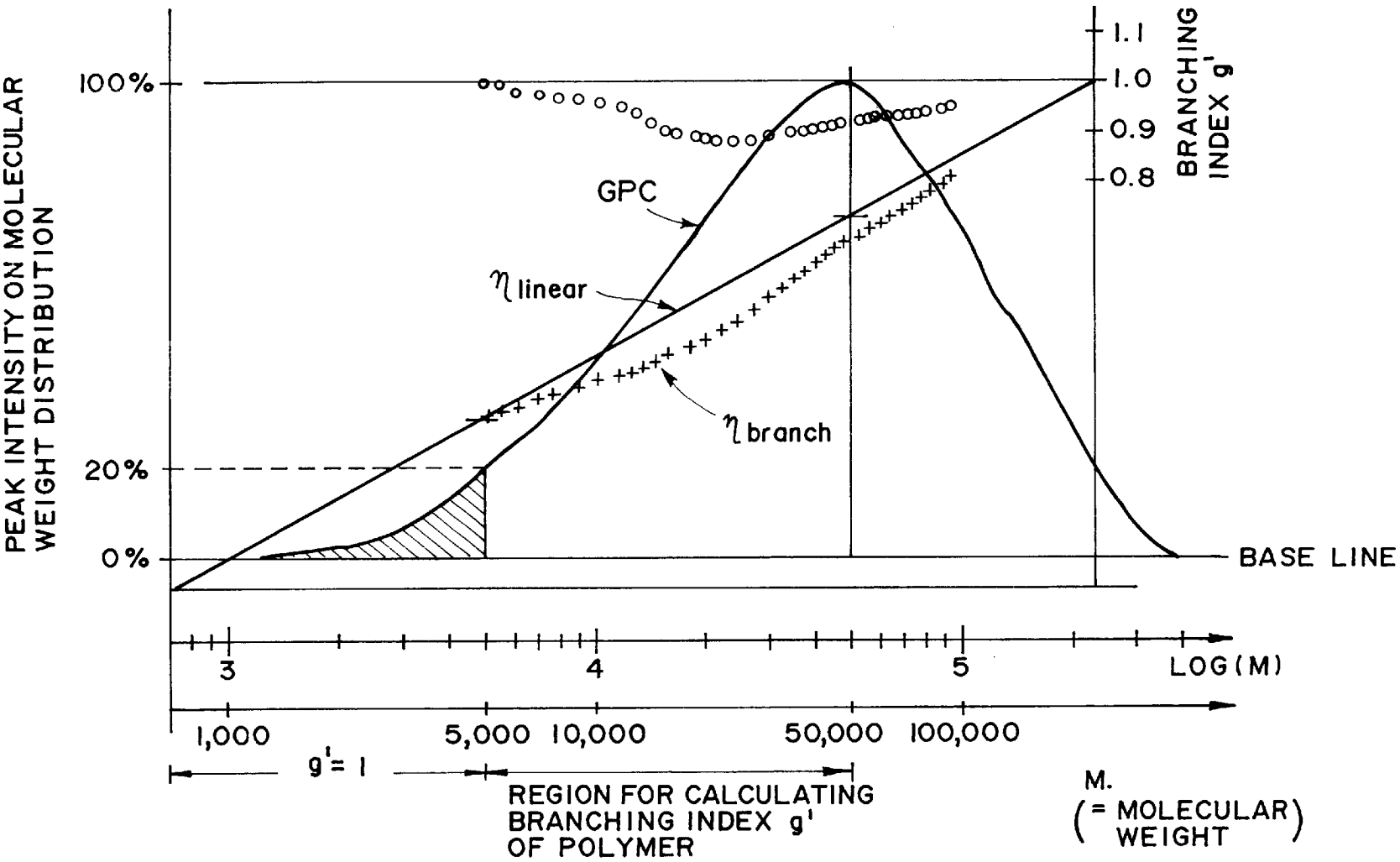
FIG. 7 is a graph for illustrating a method of calculating a branching index.

In the example shown in FIG. 7, the molecular weight corresponding to a peak intensity of 20% is 5000, and low-molecular weight components having a molecular weight of at most 5000 are equally assumed to have a branching index g'=1. An overall $[\eta_{branch}]$ in a molecular weight region of 5000–50,000 is calculated by integration based on the measured values of $[\eta_{branch}]$ of low-molecular weight fractions in the molecular weight region of 5000–50,000 and a measured molecular weight distribution in the molecular weight region. Similarly, an overall $[\eta_{linear}]$ in a molecular weight region of 5000–50,000 is calculated by integration based on the measured values of $[\eta_{branch}]$ of low-molecular weight fractions in the molecular weight region of 5000– 50,000, the measured molecular weight distribution in the molecular weight region of 5000 –50,000 and the above-obtained parameters K and $\alpha$. The ratio of $[\eta_{branch}]/[\eta_{linear}]$ thus obtained provides a branching index g' of a low-molecular weight polymer component having a molecular weight of at most $5\times10^4$ used in the present invention.

In FIG. 7, there are also shown a linear line representing $[\eta_{linear}]$ including an assumption that the component having a molecular weight of at most 5000 has a linear structure, plots "+" representing the measured viscosity values of $[\eta_{branch}]$, and plots "o" representing calculated values of branching index g' for individual fractions.

The branching index g' and the Zimm Stockmayer's branching index g of a branch polymer show a good correlation therebetween. Accordingly, it is also possible to calculate a branching index g of a branch polymer directly as a ratio $[\eta_{branch}]/[\eta_{linear}]$ between the intrinsic viscosity $[\eta_{branch}]$ of the branch polymer and the intrinsic viscosity $[\eta_{linear}]$ of a linear polymer having a molecular weight distribution identical to that of the branch polymer, as the case may be.

The binder resin component of the toner may preferably comprise a low-molecular weight polymer component providing a main peak in a molecular weight region of $2\times10^3$–$3\times10^4$ and a high-molecular weight component providing a sub-peak or shoulder in a molecular weight region exceeding $5\times10^4$, respectively, on a molecular weight distribution based on gel permeation chromatography (GPC) of tetrahydrofuran (THF)-soluble component of the binder resin component.

The THF-soluble, high molecular weight component of the binder resin preferably has a sub-peak in a molecular weight region of at least $2\times10^5$, and, more preferably, of at least $3\times10^5$.

The molecular weight distribution of toner binder resins and waxes described herein are based on values measured by GPC (gel permeation chromatography) under the following conditions.

[GPC measurement for resin components]

Apparatus: GPC-150C (available from Waters Co.)

Columns: 7 columns of KF801 - KF807 (all available from Showdex K.K.)

Temperature: 40° C.

Solvent: THF (tetrahydrofuran)

Flow rate: 1.0 ml/min.

Sample concentration: 0.05–0.6 wt. %

Sample volume: 0.1 ml

[GPC measurement for waxes]

Apparatus: GPC-150C (available from Waters Co.)

Column: 2 columns of GMH-HT (available from TOSO K.K.)

Temperature: 135° C.

Solvent: o-dichlorobenzene (containing 0.1% ionol)

Flow rate: 1.0 ml/min.

Sample concentration: 0.15 wt. %

Sample volume: 0.4 ml.

GPC chromatograms are obtained under the above-mentioned conditions, and the molecular weight levels (abscissa) of the chromatogram are determined based on a calibration curve prepared by using mono-disperse polystyrene standard samples. Further, the molecular weights of waxes are calculated based on a conversion formula derived from a Mark-Houwink viscosity formula.

The resin composition according to the present invention may preferably have a ratio (Mw/Mn) between weight-average molecular weight (Mw) and number-average molecular weight of greater than 30. If the ratio Mw/Mn is 30 or below, it is difficult to accomplish a higher degree of balance between the low-temperature fixability and the anti-offset characteristic. Mw/Mn may more preferably be at least 35.

By controlling the molecular structure of the constituents thereof, the resin composition according to the present invention can exhibit good durability without impairing the developing performance. In case where the resin composition is provided with two separate peaks in molecular weight distribution and applied to a toner containing a high-density additive, such as magnetic fine particles, remarkable effects are exhibited.

The binder resin used in the present invention may be obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process provides a difficulty that, in the presence of a low-molecular weight polymer component, it is difficult to form an adequately high-molecular weight component and an unnecessary low-molecular weight component is by-produced. Accordingly, the solution blend process is most suitable in the present invention.

The low-molecular weight component in the binder resin component in the present invention may be produced through known processes, inclusive of; a chain transfer process wherein a second monomer is radically polymerized in the presence of a polymer having a chain transfer-inducing group in its recurring units or as a terminal group; a polymer initiator process wherein a second monomer is polymerized in the presence of a polymer having an initiator group in its recurring units or as a terminal group as an initiator; grafting by irradiation with radiation rays; a mechano-chemical reaction process; and bonding process as by addition or condensation. A low-molecular weight polymer may easily be produced under a mild condition by controlling the initiator amount or reaction temperature. It is particularly preferred to use a chain transfer based on solution polymerization capable of utilizing a difference in chain transfer function of a solvent depending on the solvent species. More specifically, it is suitable to use a process wherein a preliminarily prepared prepolymer is subjected to hydrogen-abstraction by using an initiator having a hydrogen-abstracting ability to provide a polymer radical, and a second monomer is graft-polymerized with the polymer radical as the grafting site.

As a polymerization initiator having excellent hydrogen-abstracting ability, it is preferred to use an initiator having the following peroxide group in its molecule:

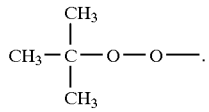

Examples of the polymerization initiator having the above structure may include: 1,1-bis(tert-butylperoxy)

cyclohexane, 1,1-bis(tert-butylperoxy)-3,3,5-trimethylcyclohexane, 2,2-bis(tert-butylperoxy)octane, di-tert-butylperoxide, tert-butylcumyl peroxide, 2,5-dimethyl-2,5-di(tert-butylperoxy)hexane, tert-butyl peroxyacetate, tert-butyl peroxyisobutylate, tert-butyl peroxypivarate, tert-butyl peroxyneodecanoate, tert-butyl peroxy-2-ethylhexanoate, tert-butyl peroxy-3,5,5-trimethylhexanoate, tert-butyl peroxylaurate, tert-butyl peroxybenzate, di-tert-butyl peroxyisophthalate, and tert-butyl peroxyisopropylcarbonate.

Among the above polymerization initiators, it is preferred to use a type of initiators not readily resulting in a crosslinked structure when generating free radicals on decomposition, such as 1,1,1-bis(tert-butylperoxy)-3,3,5-trimethylcyclohexane, di-tert-butyl peroxide and tert-butylcumyl peroxide.

These polymerization initiators may be used singly or in mixture of two or more species. In order to control the desired molecular structure it is preferred to add 0.2–5 wt. parts of such a polymerization initiator together with a second monomer per 100 wt. parts of the above-mentioned prepolymer. The polymerization of the second monomer may preferably be performed at a temperature which is in the range of −10° C. to +20° C., more preferably −5° C. to +10° C., of a decomposition temperature giving a half life of 1 minute of the polymerization initiator.

In case where the low-molecular weight component of the binder resin component of the present invention is composed as a styrene copolymer or a styrene-(meth)acrylic copolymer as described hereinafter, the prepolymer may be prepared by polymerization under an elevated pressure so as to accomplish a low-temperature fixability and suppress the initiator amount to the minimum, thereby suppressing adverse influence of initiator residue on the chargeability.

On the other hand, the second monomer may preferably be added so as to provide a larger (meth)acrylic content than that in the prepolymer-constituting monomers. As a result, the storage stability and low-temperature fixability are satisfied in a high degree, and the developing performances are improved.

The second monomer may preferably be added in an amount of 5–50 wt. parts per 100 wt. parts of the prepolymer. If the addition amount of the second monomer is below 5 wt. parts, crosslinking reaction is promoted between polymer radicals generated by hydrogen abstraction, to result in a higher crosslinking density and thus an inferior low-temperature fixability. In excess of 50 wt. parts, by-production of oligomers is promoted, thus being liable to adversely affect the storability and chargeability of the toner or developer and result in some problem regarding matching with a certain image forming method.

The high-molecular weight component in the binder resin component used in the present invention may be produced by emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitutes a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The high-molecular weight component in the resin composition used in the present invention may suitably be produced in the presence of a polyfunctional polymerization initiator as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,l-di-t-butylperoxy-3,3,5-trimethyl-cyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)-triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyl-adipate, 2,2-bis-(4,4-di-t-butylperoxycyclohexyl)-propane, 2,2-t-butylperoxyoctane and various polymer oxides; and polyfunctional polymerization initiators having both a polymerization-initiating functional group, such as peroxide group, and a polymerizable unsaturation group in one molecule, such as diallyl-peroxydicarbonate, t-butylperoxymaleic acid, t-butylperoxyallylcarbonate, and t-butylperoxyiso-propylfumarate.

Among these, particularly preferred examples may include: 1,1-di-t-butylperoxy-3,3,5-trimethyl-cyclohexane, 1,1-di-t-butylperoxycyclohexane, di-t-butylperoxyhexahydroterephthalate, di-t-butylperoxy-azerate, 2,2-bis(4,4-di-t-butylperoxycyclohexyl)-propane, and t-butylperoxyallylcarbonate.

The polyfunctional polymerization initiator may preferably be used in proportion of 0.05–5 wt. parts per 100 wt. parts of the monomer.

The polyfunctional polymerization initiator may suitably be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin exhibiting further improved developing performances.

Examples of the monofunctional polymerization initiator may include: organic peroxides, such as di-t-butyl peroxide, dicumyl peroxide, benzoyl peroxide, t-butylperoxy-2-ethylhexanoate, and t-butylperoxybenzoate; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator. The monofunctional polymerization initiator may preferably be used in an amount of 0.05–2 wt. parts per 100 wt. parts of the monomer.

The high-molecular weight component of the binder resin component used in the present invention may preferably be prepared by polymerization in the presence of a crosslinking monomer as enumerated hereinbelow so as to satisfy the required properties according to the present invention.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanedi-acrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylpropane triacrylate, tetramethylolmethane tetraacrylate, oligoester acrylate, and compounds obtained by substituting methacrylate groups for the acrylate groups in the above compounds; triallyl cyanurate and triallyl trimellitate.

These crosslinking monomers may preferably be used in a proportion of 1 wt. part or less, per 100 wt. parts of the other vinyl monomer components. As a result, the resultant toner can exhibit good low temperature fixability and anti-offset characteristic in combination, and also improved storability.

Among the above-mentioned crosslinking monomers, aromatic divinyl compounds (particularly, divinylbenzene) and diacrylate compounds connected with a chain including an aromatic group and an ether bond may suitably be used, particularly in an amount of 0.001–0.05 wt. part per 100 wt. parts of the other monomer components. As a result, the toner even in a fine particle size can exhibit stable developing performances and improved continuous image forming characteristic. Further, the resin shows a good matching with wax component described hereinafter.

The high-molecular weight component in the binder resin may be allowed to contain polymerized units of a monomer having at least one of carboxyl group, carboxylic acid salt group and carboxylic anhydride group so as to have an increased crosslinking degree through a heat-melt kneading step for toner production. Particularly, in case of using a binder resin of a low viscosity, the respective components constituting the toner can be supplied with a stronger shearing force uniformly due to the thickening effect of the crosslinking, so that the dispersibility of the respective components can be improved synergistically to provide stable developing performances. Such a resin also shows a good matching with a wax component described hereinafter.

In order to exhibit prescribed effect through crosslinking, it is preferred to include the above-mentioned carboxylic group within an extent of not impairing the developing performances. More specifically, the high-molecular weight component of the binder resin of the toner according to the present invention may preferably have an acid value of 0.5–30.

The polymer component having a functional group capable of forming a crosslinking may preferably be a polymer having at least one of carboxyl group, carboxylic anhydride group and carboxylic salt group so as to exhibit a good reactivity. Examples of the carboxyl group-containing monomer for synthesizing a vinyl polymer may include: acrylic acid and α- or β-alkyl derivatives thereof, such as acrylic acid, methacrylic acid, α-ethylacrylic acid, and crotonic acid; and unsaturated dicarboxylic acids, such as fumaric acid, maleic acid and citraconic acid, and monoester derivatives thereof. Desired polymers may be synthesized by polymerizing these monomers alone or in mixture, or by copolymerization of these monomers with other monomers. Among these, it is particularly preferred to use monoester derivatives of unsaturated dicarboxylic acids.

Preferred examples of the carboxyl group-containing monomer used in the present invention may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate; and monoesters of aromatic dicarboxylic acids, such as monomethyl phthalate, monoethyl phthalate and monobutyl phthalate.

The above-mentioned carboxyl group-containing monomer may preferably constitute 1–30 wt. %, particularly 3–20 wt. %, of the total monomers providing the high-molecular weight component of the binder resin.

A reason why a monomer in the form of a dicarboxylic acid monoester is preferred is that an acid monomer having a high solubility in an aqueous suspension medium is not suitable but an ester having a lower solubility is preferred in suspension polymerization.

In the present invention, the carboxylic acid group and carboxylic acid ester site can be subjected to saponification by an alkalline treatment. It is also preferred to convert the carboxylic acid group and the carboxylic acid ester site into a polar functional group by reaction with an alkalline cationic component. This is because, even if a carboxylic group potentially capable of reacting with a metal-containing organic compound is contained in the high-molecular weight component, the crosslinking efficiency thereof is lowered, if the carboxylic acid group is in the form of an anhydride, i.e., cyclized.

The alkalline treatment may be performed by adding an alkali into the solvent medium after the preparation of the binder resin. Examples of the alkali may include:.hydroxides of alkalline metal or alkaline earth metals, such as Na, K, Ca, Li, Mg and Ba; hydroxides of transition metals such as Zn, Ag, Pb and Ni; and ammonium hydroxide, alkylammonium hydroxides, such as pyriminium hydroxide. Particularly preferred examples may include NaOH and KOH.

In the present invention, the above-mentioned saponification need not be effected with respect to all the carboxylic acid group and carboxylic ester site of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester cite, can receive adverse effects, such as hydrolysis and salt formation.

If the alkaline treatment in an amount of 0.02–5 equivalents to the acid value is effected, the remaining cation concentration may be within the range of 5–1000 ppm.

The toner according to the present invention can contain a metal-containing organic compound in order to promote crosslinking between polymer chains in the resin composition during the toner production. It is particularly preferred to use metal-containing organic compounds including an organic compound rich in vaporizability or sublimability as a ligand or counter ion because excellent results are attained thereby.

Examples of such an organic compound capable of forming a ligand or counter-ion for a metal ion and having the above-mentioned property may include salicylic acid and derivatives thereof, such as salicylamide, salicylamine, salicylaldehyde, salicylosalicylic acid, and di-tert-butylsalicylic acid; β-diketones, such as acetylacetone, and propionacetone; and low-molecular weight carboxylic acid salts, such as acetates and propionates.

Examples of the monomer used for constituting the binder resin used in the toner according to the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α, β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

In a preferred embodiment of the toner according to the present invention, a low-molecular weight wax may be added to the toner.

Examples of the low-molecular weight wax usable in the present invention may include: waxy substances, such as polypropylene, polyethylene, microcrystalline wax, carnauba wax, sasol wax, and paraffin wax, and oxidized and graft-modified products thereof. These waxes may be used singly or in mixture of two or more species.

The low-molecular weight wax may preferably have a weight-average molecular weight of at most $3\times10^4$, more preferably at most $10^4$. The addition amount thereof may preferably be about 1–20 wt. parts per 100 wt. parts of the binder polymer component.

The low-molecular weight wax used in the present invention may preferably contain at least 60 wt. %, more preferably at least 70 wt. %, of a compound represented by the formula: R-Y, wherein R represents a hydrocarbon group having a weight-average molecular weight as measured by GPC, and Y denotes hydroxyl group, carboxyl group, alkyl ether group, ester group or sulfonyl group, so as to accomplish the object of the present invention at a high degree. The wax can show a good matching or affinity with the above-mentioned binder resin. Specific examples of the compound may include the following:

(A) $CH_3(CH_2)_nCH_2OH$ (n=ca. 20–ca. 200)

(B) $CH_3(CH_2)_nCH_2COOH$ (n=ca. 20–ca. 200)

(C) $CH_3(CH_3)_nCH_2OCH_2(CH_2)_mCH_3$ (n=ca. 20–ca. 200, m=0 - ca. 100)

(D) $CH_3(CH_3)_nCH_2COO(CH_2)_mCH_3$ (n=ca. 20–ca. 200, m=0 - ca. 100)

(E) $CH_3(CH_2)_nCH_2OSO_3H$ (n=ca. 20–ca. 200)

All of these compounds have a main chain of a linear hydrocarbon, and the compounds (B)–(E) may be derived from the compound (A). Other compounds derivable from the compound (A) may also be used.

The above compound may preferably have a number-average molecular weight (Mn) of 200–2000, a weight-average molecular weight of 400–3000, and a ratio Mw/Mn of at most 3.0. As a result of such a molecular weight distribution, the resultant toner can be provided with preferred physical properties. If the molecular weight is below the ranges, the resultant toner can be excessively susceptible of thermal influence and mechanical influence and can be accompanied with problems regarding the anti-offset characteristic and storability. If the molecular weight exceeds the ranges, the effect of addition of the compound is reduced.

In toner production, the low-molecular weight wax may preferably be added to and mixed with the binder resin in advance. It is particularly preferred to preliminarily dissolve the low-molecular weight wax and the high-molecular weight polymer in a solvent, and mix the resultant solution with a solution of the low-molecular weight polymer, thereby producing a binder resin. As a result of preliminary mixing of the low-molecular weight wax component and the high-molecular weight component, microscopic phase separation can be alleviated, the high-molecular weight component is not re-agglomerated, and a good dispersion state of the low-molecular weight component can be attained.

Such polymer solutions may preferably have a solid content of 5–70 wt. % in view of dispersion efficiency, prevention of denaturation of the resin under stirring and operability. More particularly, the preliminary solution of the high-molecular weight polymer component and the low-molecular weight wax may preferably have a solid content of 5–60 wt. %, and the low-molecular weight polymer solution may preferably have a solid content of 5–70 wt. %.

The high-molecular weight polymer component and the low-molecular weight wax may be dissolved or dispersed under stirring either batchwise or continuously to prepare the preliminary solution.

The blending with the low-molecular weight polymer solution may preferably be performed by blending the low-molecular weight polymer solution in an amount of 10–1000 wt. parts with the preliminary solution containing 100 wt. parts of the solid content. The blending may be performed either batchwise or in a continuous manner.

It is further preferred to blend 5–100 wt. parts, more preferably 10–80 wt. parts, of the low-molecular weight polymer component with 10 wt. parts the solid content in the preliminary solution.

Examples of the organic solvent used for the solution blending for preparation of the resin composition according to the present invention may include: hydrocarbon solvents, such as benzene, toluene, xylene, solvent naphtha No. 1, solvent naphtha No. 2, solvent naphtha No. 3, cyclohexane, ethylbenzene, Solvesso 100, Solvesso 150 and mineral sprit; alcohol solvents, such as methanol, ethanol, iso-propyl alcohol, n-butyl alcohol, sec-butyl alcohol, iso-butyl alcohol, amyl alcohol, and cyclohexanol; ketone solvents, such as acetone, methyl ethyl ketone, methyl isobutyl ketone, and cyclohexanone; ester solvents, such as ethyl acetate, n-butyl acetate, and cellosolve acetate; and ether solvents, such as methyl cellosolve, ethyl cellosolve, high cellosolve and methyl carbitol. Among these, aromatic, ketone and/or ester solvents may be preferred. These solvents can be used in mixture.

The organic solvent may preferably be removed by removing 10–80 wt. % thereof by heating the polymer solution under a normal pressure and removing the remainder under a reduced pressure. In this instance, it is preferred to retain the polymer solution at a temperature which is at least the boiling point of the solvent and at most 200° C. Below the boiling point, not only the efficiency of the solvent removal is lowered, but also the polymers within the organic solvent receive an unnecessary shearing force to promote re-distribution of the component polymers, thus being liable to cause microscopic phase separation. In excess of 200° C., the de-polymerization of the polymerization is liable to occur, thus not only resulting in oligomers due to molecular severance but also being liable to result in monomers which may be entrained into the product resin.

The toner binder resin composition prepared through the above-mentioned production process is excellent not only in dispersibility of the low-molecular weight wax but also in compatibility between the low-molecular weight polymer and the high-molecular weight.

The resin composition contained in the toner according to the present invention may preferably show a glass transition temperature of 50–70° C. If the glass transition temperature is below 50° C., the toner is liable to be deteriorated in a high temperature environment and cause an offset at the time of fixation. In excess of 70° C., the fixability can be adversely affected.

The glass transition temperature Tg may be measured by using a differential scanning calorimeter (e.g., "DSC-7" available from Perkin Elmer Inc.) in the following manner.

The measurement sample is accurately weighed at 5–20 mg, preferably around 10 mg.

The sample is placed on an aluminum pan and subjected to heating in a range of 30–200° C. at a rate of 10° C./min in a normal temperature-normal humidity environment with reference to an empty aluminum pan. In the temperature raising stage, a main absorption peak may appear in a temperature range of 40–100° C. Base lines are taken both before and after the appearance of the absorption peak, and an intermediate line is drawn passing between the base lines. An intersection of the intermediate line and the DSC curve may provide a corresponding temperature which is taken as the glass transition temperature of the sample.

In the toner according to the present invention, it is preferred to add a charge control agent in order to provide a charging stability and an improved developing performance.

Examples of the positive charge control agents may include: nigrosine, azine dyes having a $C_2$–$C_{16}$ alkyl group (JP-B 42-1627); basic dyes, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44025), C.I. Basic Green I (C.I. 42040) and C.I. Basic Green 4 (C.I. 42000); lake pigments of these basic dyes (the laking agents including, e.g., phosphotungstic acid, phosphomolybdic acid, phosphotungsticmolybdic acid, tannic acid, lauric acid, gallic acid, ferricyanates, and ferrocyanates); C.I. Solvent Black 3 (C.I. 26150), Hansa Yellow G (C.I. 11680), C.I. Mordant Black 11, and C.I. Pigment Black 1.

Further examples may include: quaternary ammonium salts, such as benzylmethylhexadecylammonium chloride, and decyltrimethylammonium chloride; amino group-containing vinyl polymers, and polyamide resins such as amino group-containing condensate polymers. Preferred examples may include: nigrosine, quaternary ammonium salts, triphenylmethane-type nitrogen-containing compounds, and polyamides.

Examples of the negative charge control agents may include: metal complexes of monoazo dyes as disclosed in JP-B 41-20153, JP-B 42-27596, JP-B 44-6397, and JP-B 45-26478; nitroamine acid, its salt and dyes or pigments such as C.I. 4645 as disclosed in JP-A 50-133338; complexes of metals, such as Zn, Al, Co, Cr and Fe with salicylic acid, naphthoic acid and dicarboxylic acid as disclosed in JP-B 55-42752, JP-B 58-41508, JP-B 58-7348 and JP-B 59-7385; sulfonated copper phthalocyanine pigment, nitro- or halogen-introduced styrene oligomers, and chlorinated paraffin. Preferred examples of the negative charge control agents may include: metal complexes of salicyclic acid, metal complexes of naphthoic acids, metal complexes of dicarboxylic acid, and metal complexes of derivative of there acids. In view of the dispersibility, it is particularly preferred to use an azo metal complex represented by the formula [I] below or a basic organic acid metal complex represented by the formula (II) below:

[I]

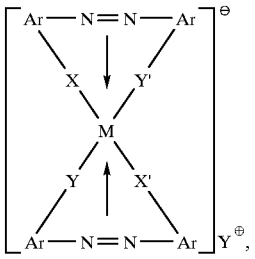

wherein M denotes a coordination center metal, inclusive of metal elements having a coordination number of 6, such as Cr, Co, Ni, Mn and Fe; Ar denotes an aryl group, such as phenyl or naphthyl, capable of having a substituent, examples of which may include:

nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $Y^{\oplus}$ denotes hydrogen, sodium, potassium, ammonium or aliphatic ammonium.

[II]

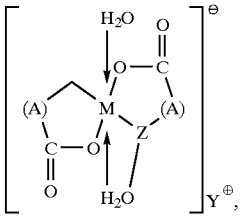

wherein M denotes a coordination center metal, inclusive of metal elements having a coordination number of 6, such as Cr, Co, Ni, Mn and Fe; A denotes

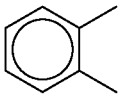

(capable of having a substituent, such as an alkyl),

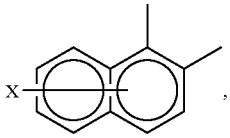

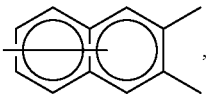

-continued

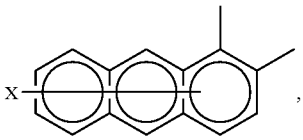

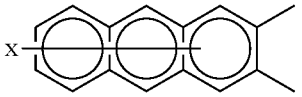

(X denotes hydrogen alkyl, halogen, or nitro),

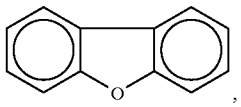

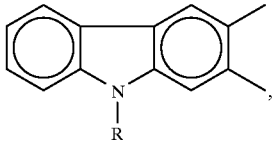

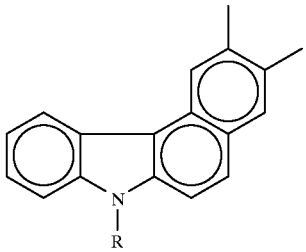

(R denotes hydrogen, $C_1$–$C_{18}$ alkyl or $C_1$–$C_{18}$ alkenyl); $Y^{\oplus}$ denotes a counter ion, such as hydrogen, sodium, potassium, ammonium, or aliphatic ammonium; and Z denotes —O— or —CO•O—.

Specific examples of the azo metal complex [I] and the basic organic acid metal complex [II] may include the following:

Complex [I]-1
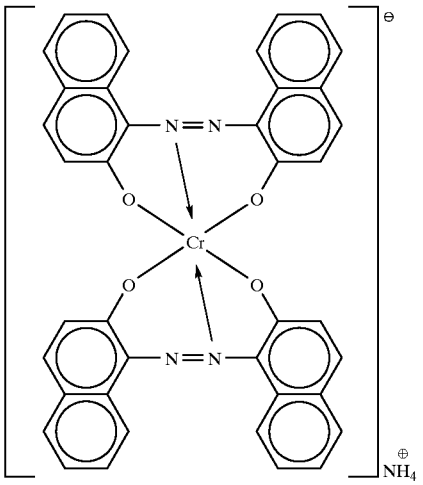
Complex [I]-2
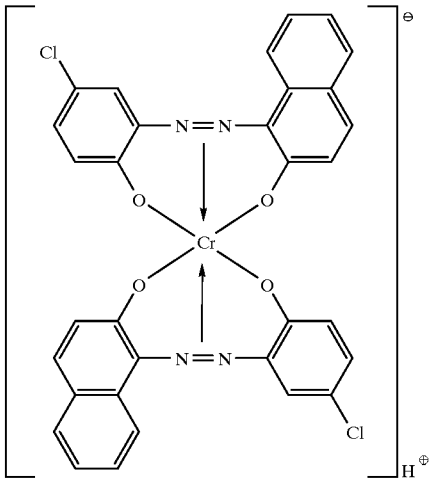
Complex [I]-3
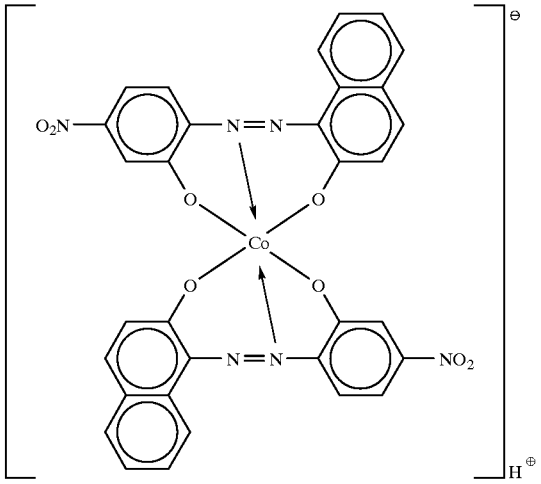

-continued
Complex [I]-4
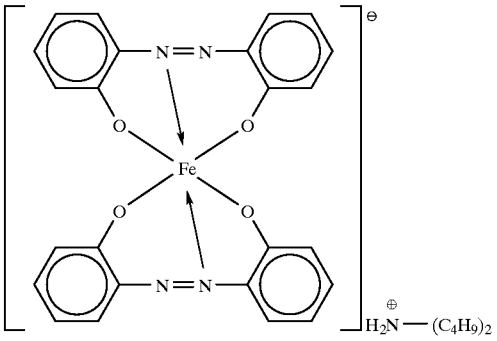
Complex [I]-5
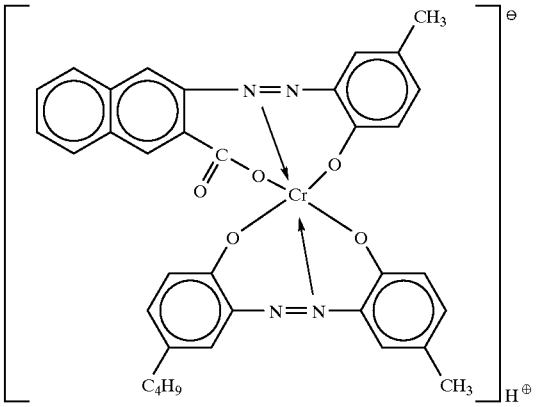
Complex [I]-6
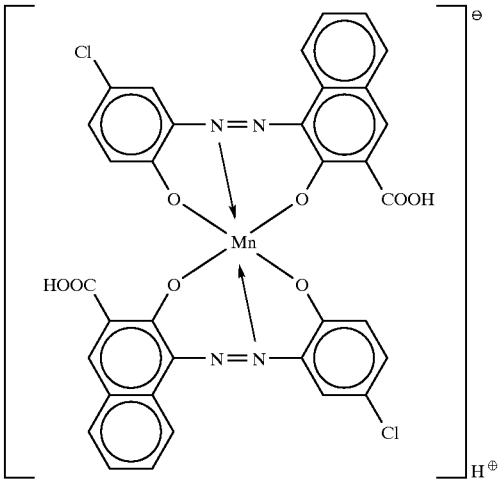

-continued
Complex [I]-7
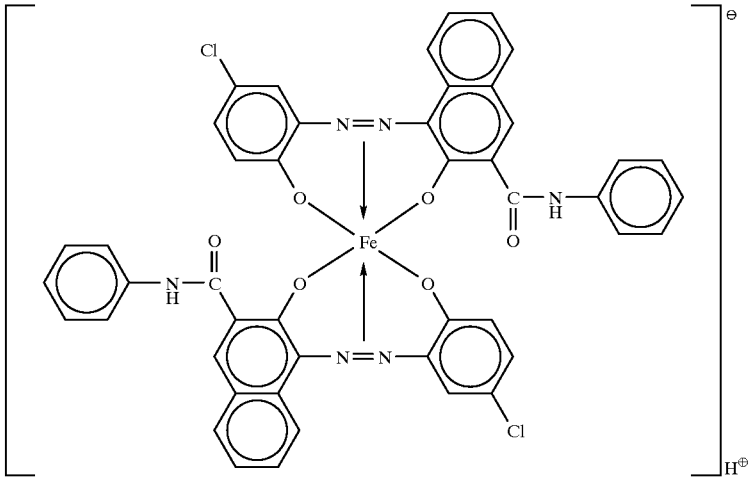
Complex [II]-1
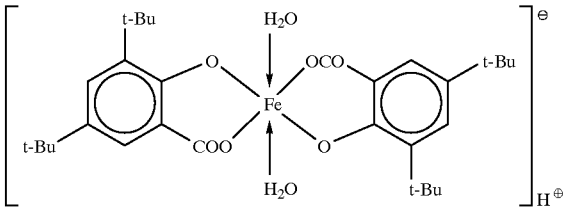
Complex [II]-2
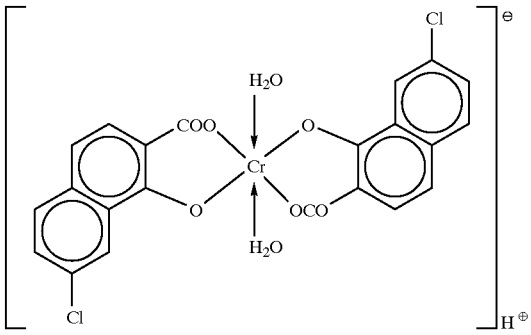
Complex [II]-3
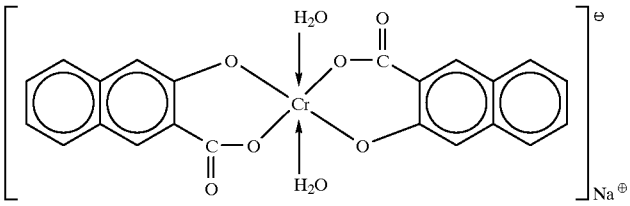
Complex [II]-4
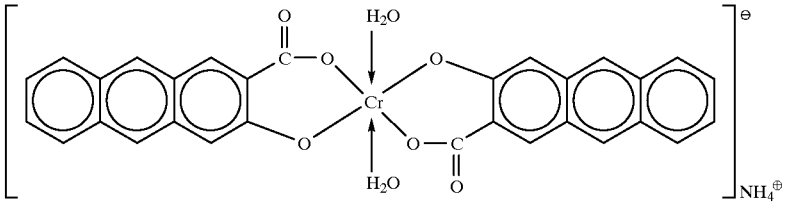

-continued

Complex [II]-5

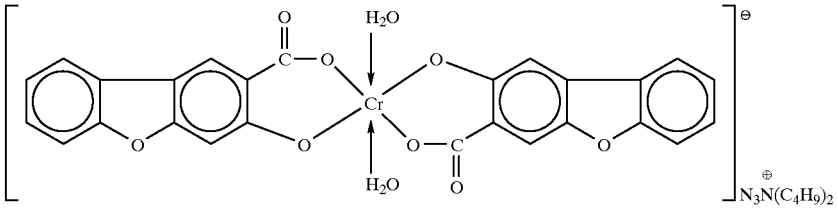

Complex [II]-6

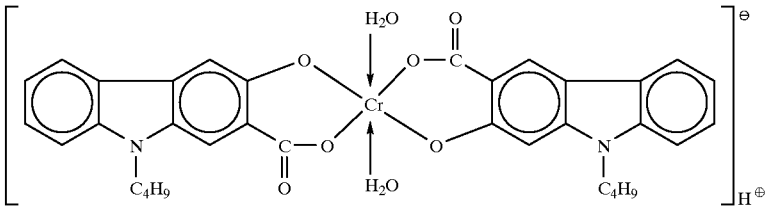

Complex [II]-7

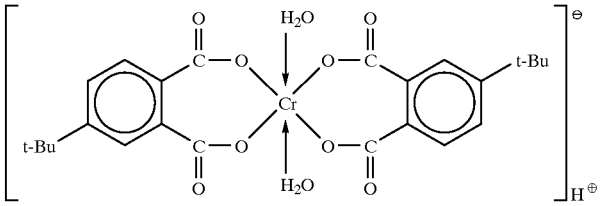

Complex [II]-8

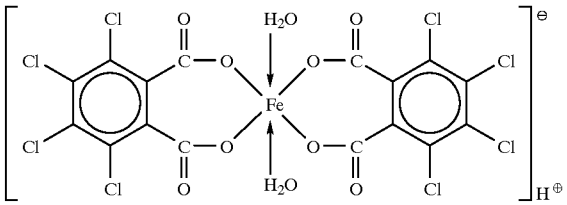

Complex [II]-9

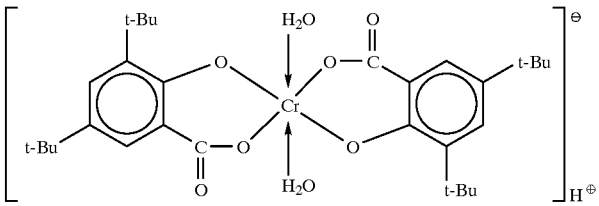

Complex [II]-10

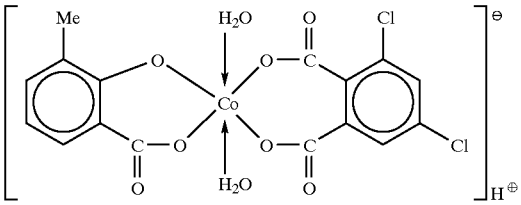

These metal complexes may be used singly or in combination of two or more species.

In case where the above metal complex is used as a charge control agent, the metal complex may preferably be added in an amount of 0.1–5 wt. parts per 100 wt. parts of the binder resin so as to retain a good triboelectric chargeability while minimizing adverse effects thereof, such as soiling of the developing sleeve surface leading to a lower developing performance and a lower environmental stability.

It is preferred to use the toner according to the present invention together with inorganic fine powder blended therewith in order to improve the charge stability, developing characteristic and fluidity.

The inorganic fine powder may include silica fine powder, titanium oxide fine powder and alumina fine powder. The inorganic fine powder used in the present invention provides good results if it has a specific surface area of 30 $m^2/g$ or larger, preferably 50–400 m2/g, as measured by nitrogen adsorption according to the BET method. The inorganic fine powder may be added in a proportion of 0.01–8 wt. parts, preferably 0.1–5 wt. parts, per 100 wt. parts of the toner particles.

For the purpose of being provided with hydrophobicity and/or controlled chargeability, the inorganic fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoro-ethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may be a known one, examples of which may include: powder having magnetism, such as iron powder, ferrite powder, and nickel powder; glass beads; and carriers obtained by coating these powders or beads with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 micron, preferably 0.1–0.5 micron.

The magnetic material may preferably show magnetic properties under application of 10 kilo-Oersted, inclusive of: a coercive force of 20–250 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a non-magnetic colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the organic metal compound such as the metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification to obtain toner particles.

The thus obtained toner particles may be further blended with other external additives, as desired, by means of a mixer such as a Henschel mixer to provide a toner for developing electrostatic images according to the present invention..

Figure 6:
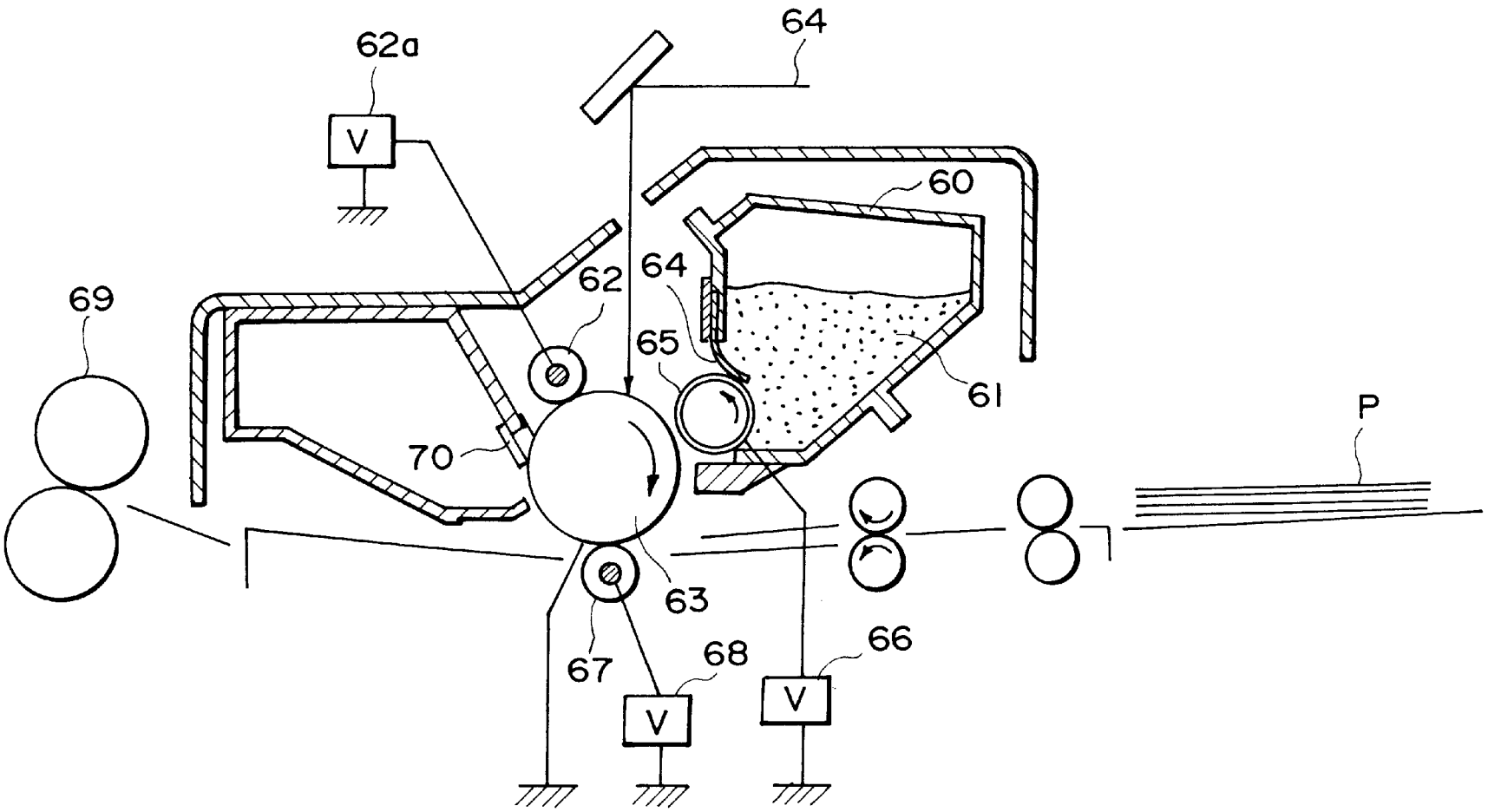
FIG. 6 is a schematic illustration of an image forming apparatus used for practicing an embodiment of the image forming method according to the present invention.

Next, an embodiment of the image forming method according to the present invention will be described with reference to FIG. 6. FIG. 6 shows an electrophotographic apparatus usable as an example of a copying machine or a printer for practicing the image forming method according to the present invention. The apparatus includes a developing means 60 containing a toner 61 according to the present invention. The toner may be a magnetic toner or a non-magnetic toner. In an image forming apparatus other than the one shown in FIG. 6, it is possible to use a developing means including a two-component type developer comprising a toner and a carrier.

Referring again to FIG. 6, the surface of a photosensitive member 63 (e.g., an OPC photosensitive drum, an amorphous silicon photosensitive drum or a polysilicon photosensitive drum) is charged by a charging means 62 (e.g., a contact charging means such as a charging roller as shown, a charging brush or a charging blade) supplied with a voltage from a bias voltage application means 62*a*. Then, the charged surface of the photosensitive member 63 is irradiated with light 64 (e.g., laser light or light from a halogen lamp) carrying image data to form an electrostatic image on the photosensitive member. The electrostatic image is developed with a magnetic toner 61 (in this embodiment) on a developing sleeve 61 enclosing a magnetic field generating means (e.g., a magnet) of the developing means 60 also equipped with a toner applicator blade 64 (e.g., an elastic blade or a magnetic blade) for applying the toner 61 onto the developing sleeve 65. The development is performed by either the normal development scheme or the reversal development scheme to form a toner image on the photosensitive member 63. At the developing station, the developing sleeve may be supplied, as desired, with an alternating, a pulse, and/or a DC bias voltage from a bias voltage application means 66. When the toner image on the photosensitive member arrives at a transfer station to which also a transfer material is conveyed, the back side (side opposite the photosensitive member 63) of the transfer member P is pressed and charged by a transfer means 67 (e.g., a transfer roller as shown or a transfer belt) to electrostatically transfer the toner image on the photosensitive member 63 onto the transfer material P. As the case may be, the toner image on the photosensitive member 63 can be transferred onto an intermediate transfer member (not shown, such as an intermediate transfer drum or an intermediate transfer belt) and then to the transfer material P.

The toner image on the transfer material P separated from the photosensitive member 63 may be fixed onto the transfer material P by a heat-and-pressure application means 69 (e.g., a heat-pressure roller fixing means as shown). A portion, if any, of the toner remaining on the photosensitive member 63 after the transfer step may be removed, as desired, from the surface of the photosensitive member 63 by a cleaning means 70 (e.g., a cleaning blade as shown, a cleaning roller or a cleaning brush). The photosensitive member after the cleaning is again subjected to an image forming cycle as described above starting from the charging step by the charging means 62.

The photosensitive member 63 as an electrostatic image-bearing member generally comprises a photosensitive layer and an electroconductive substrate and is rotated in the direction of an arrow as indicated. The developing sleeve 65 comprising a non-magnetic cylinder as a toner carrying member is rotated in the same direction as the photosensitive member 63 at the developing station. Inside the developing sleeve 65, a multi-polar permanent magnet (magnet roll) as a magnetic field-generating means is fixedly disposed. The magnetic toner 61 contained inside the developing means 60 is applied by the applicator blade 64 onto the surface of the developing sleeve, and the toner particles constituting the toner are triboelectrically charged by friction with the applicator blade 64 and/or the developing sleeve 65. The toner may be uniformly applied by the applicator blade 64 in a layer of e.g., 10–300 $\mu$m on the surface of the developing sleeve 65. At the developing station, the developing sleeve 65 may be supplied with an AC bias voltage of f=200–4000 Hz and Vpp=500–3000 V.

At the developing station, toner particles are transferred onto the electrostatic image on the photosensitive member due to the electrostatic force of the photosensitive member surface and the action of an AC or pulse bias voltage.

Figure 2:
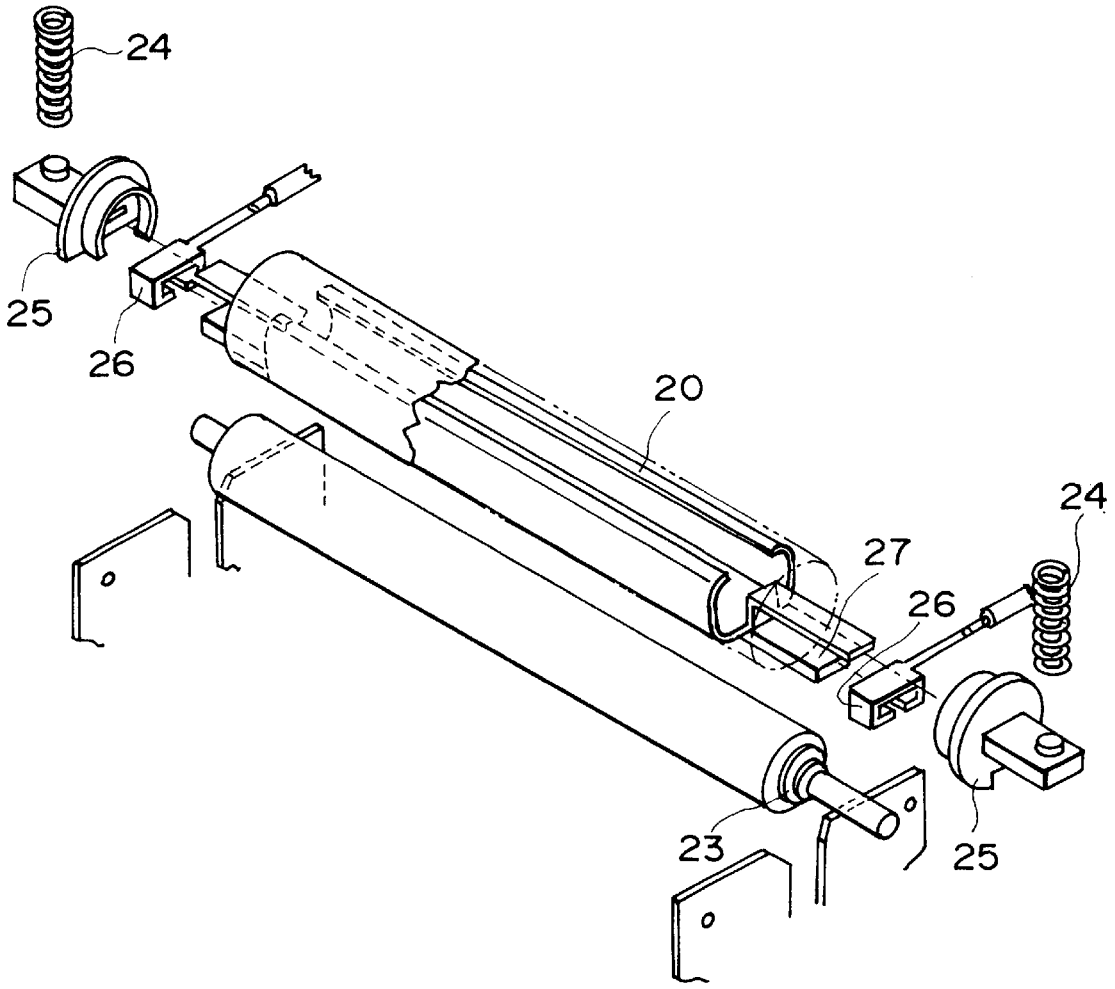
FIG. 2 is an exploded perspective view of essential parts of a fixing apparatus used in Examples of the invention.
Figure 3:
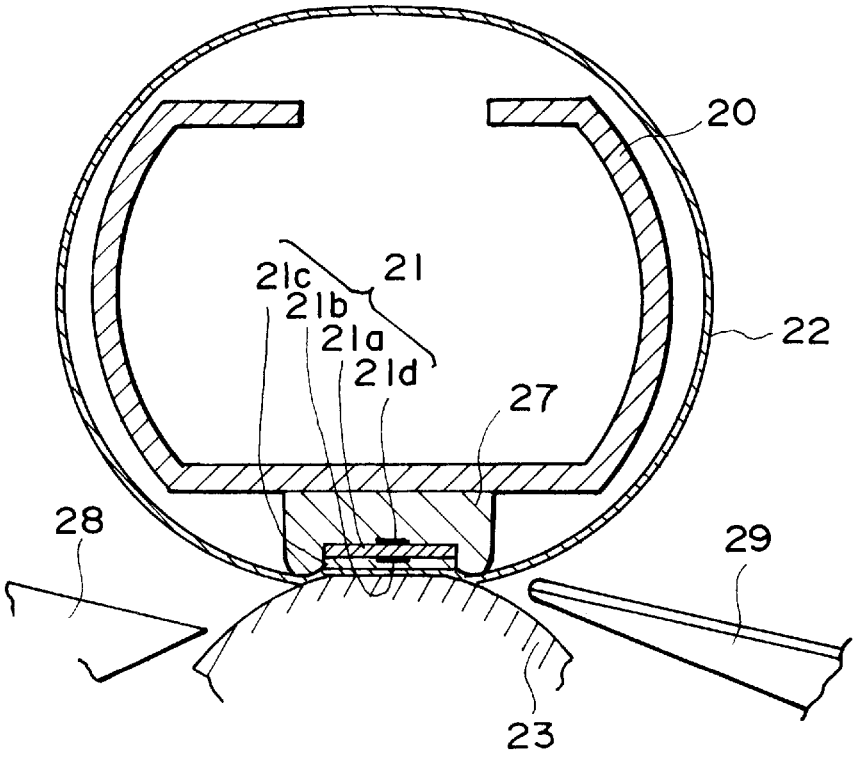
FIG. 3 is an enlarged sectional view of a fixing apparatus including a film in a non-driven state used in Examples of the present invention.

Incidentally, in Examples described hereinafter, an image forming apparatus having structure as shown in FIGS. 1 to 3 was used, of which the included members are denoted by reference numerals as shown below.

That is, reference numeral 10 denotes an electrostatic image-bearing member (photosensitive drum); 11, a charger (charging roller); 12, a process-cartridge; 13, a cleaning means; 14, an exposure means; 15, a developer container; 16, a developer-carrying member (developing sleeve); 17, a magnetic field generating means; 18, a layer thickness-regulating elastic member; 19, a transfer means (transfer roller); 20, a stay; 21, a heating member; 21*a,* a heater substrate; 21*b,* a heat-generating member; 21*c,* a surface protective layer; 21*d,* a temperature-detecting element; 22, a fixing film; 23, a pressing roller; 24, a coil spring; 25, a film edge-regulating member; 26, an electricity-supplying connector; 27, an electricity interrupting member; 28, an inlet guide; and 29, an outlet guide (separation guide).

Figure 5:
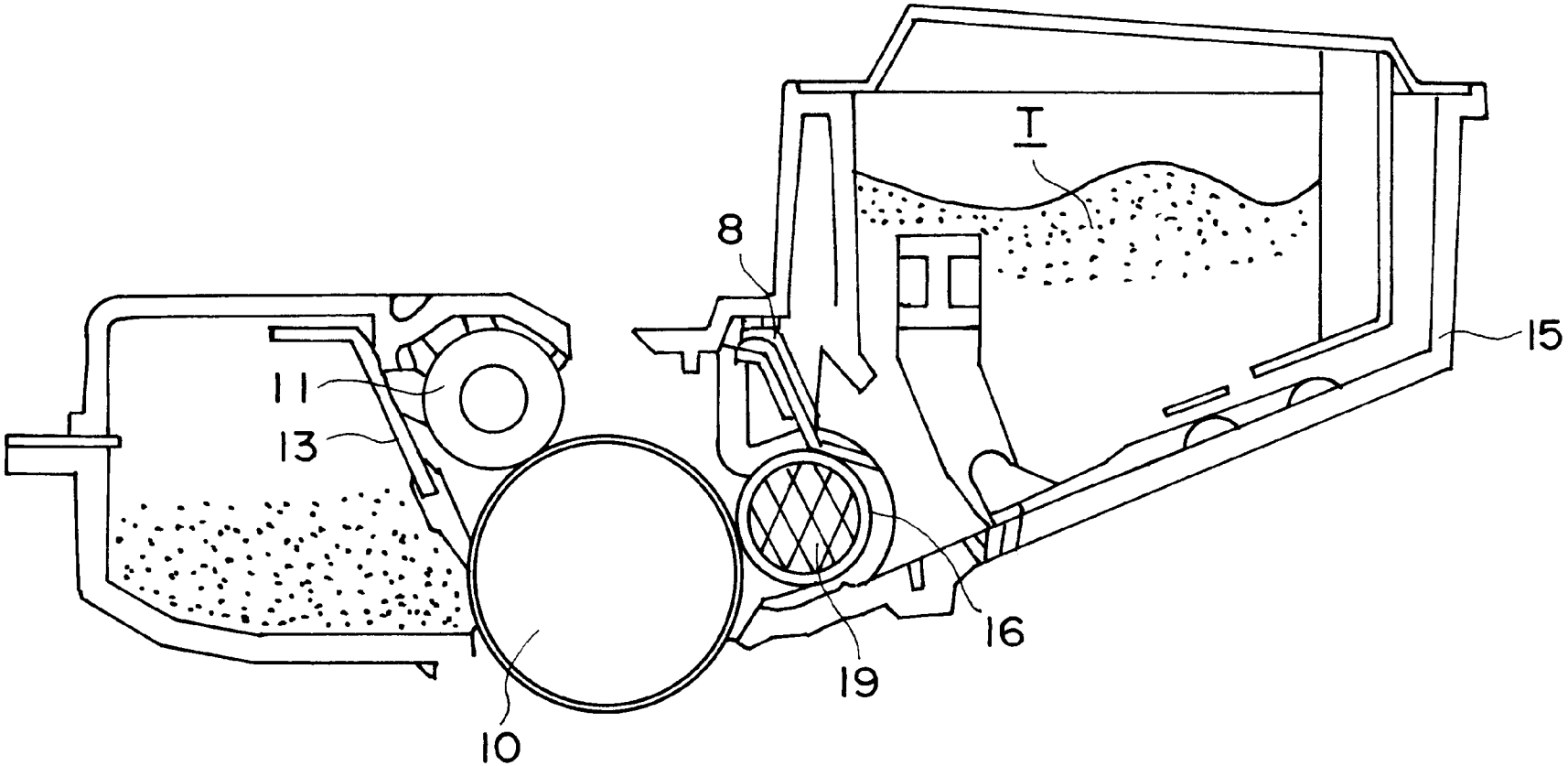
FIG. 5 is a schematic illustration of an embodiment of the process-cartridge according to the present invention.

Further, FIG. 5 is a schematic sectional view of a process-cartridge detached from a main body of an image forming apparatus as described above. The process-cartridge at least includes a developing means and an electrostatic image-bearing member which are integrated into a cartridge, so as to be detachably mountable to a main body of an image forming apparatus, such as a copying machine or a laser beam printer.

In this embodiment shown in FIG. 5, the process-cartridge integrally includes a developing means, a drum-shaped electrostatic image bearing member (photosensitive drum) 10, a cleaner including a cleaning blade 13, and a primary charger (charging roller) 11.

In this embodiment, the developing means includes a toner layer thickness-regulating member 18 and a toner vessel 15 containing a magnetic toner T. At the time of development, a prescribed bias electric field is applied between the photosensitive drum 10 and the developing sleeve 16 carrying the magnetic toner T to effect a development of an electrostatic image formed on the photosensitive drum 10.

Hereinbelow, the present invention will be described based on specific Examples, to which the present invention is however not limited.

[Production Example 1 for resin composition]

Synthesis of low-molecular weight polymers (L-1) and (L-2)

300 wt. parts of xylene was placed in a glass-made autoclave, and the system in the autoclave was sufficiently aerated with nitrogen under stirring, sealed and heated to 200° C.

While the system was held under a heat-refluxing state at the temperature, a mixture liquid of 88 wt. parts of styrene, 12 wt. parts of n-butyl acrylate and 2 wt. parts of di-tert-butyl peroxide was added dropwise in 2.5 hours, followed by holding for 1 hour to complete the polymerization thereby obtaining a solution of low-molecular weight polymer (L-1).

A part of the polymer solution was taken out and dried under a reduced pressure to recover a low-molecular weight polymer (L-1) which, on analysis, showed Mw=8,300, Mn=4,200, a peak molecular weight (PMW)=6,900 and Tg=61° C. The polymerization conversion was 98%. The polymer also showed a branching index g' of 1.05.

Then, 400 wt. parts of the solution of low-molecular weight polymer (L-1) was placed in a four-necked flask and the system was sufficiently aerated with nitrogen under stirring, followed by heating to a xylene reflux temperature (144° C.).

While the reflux state was retained at that temperature, a mixture liquid of 17.2 wt. parts of styrene, 2.8 wt. parts of n-butyl acrylate and 2 wt. parts of 1,1-bis(tert-butylperoxy)-3,3,5-trimethylcyclohexane (1 min-halflife temperature ($T_{1m}$)=148° C.) was added dropwise in 4 hours, followed by holding for 1 hour to complete the polymerization, thereby obtaining a solution of low-molecular weight polymer (L-2).

A part of the polymer solution was taken out and dried under a reduced pressure to recover a low-molecular weight polymer (L-2) which, on analysis, showed Mw=8,400, Mn=4,200, PMW=6,900, Tg=57° C., and a branching index g'=0.85. The polymerization conversion was 97%.

Synthesis of high-molecular weight polymer (H-1)

In a four-necked flask, 180 wt. parts of degassed water and 20 wt. parts of 2 wt. % polyvinyl alcohol aqueous solution were placed, and then a mixture liquid of 69 wt. parts of styrene, 26 wt. parts of n-butyl acrylate, 5 wt. parts of monobutyl maleate, 0.005 wt. part of divinylbenzene and 0.1 wt. part of 2,2-bis(4,4-di-tert-butylperoxycyclohexyl)-propane (a 10 hour-halflife temperature ($T_{10h}$)=92° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 2 times equivalent to the acid value (AV=8.0) of the resultant high-molecular weight polymer (H-1) was added, and the system was stirred for 2 hours.

The resultant high-molecular weight polymer (H-1) was filtered out, washed with water, dried and, as a result of measurement, showed Mw=$1.8\times10^6$, Mn=$1.1\times10^5$, PMW=$1.2\times10^6$, Tg=62° C., a THF-insoluble content of 2.3% (substantially negligible), and a branching index g'=1.22.

Production of binder resin

In a four-necked flask, 100 wt. parts of xylene, 25 wt. parts of the above high-molecular weight polymer (H-1), 3 wt. parts of low-molecular weight polyethylene (Mw=800) and 7 wt. parts of higher alkyl alcohol (Mw=900, Mn=450) including a principal component represented by the formula of $CH_3(CH_2)_{20-60}CH_2OH$ were placed and heated and stirred under reflux to effect preliminary dissolution. The system was retained for 12 hours in the state to obtain a preliminary solution (Y-1) wherein the polymer H-1 and the low-molecular weight polyethylene and the higher alkyl alcohol were uniformly mixed.

The solid matter in the preliminary solution showed Tg=58° C.

Separately, 260 wt. parts of the above-mentioned uniform solution of low-molecular weight polymer (L-2) was placed in another vessel and refluxed.

The above preliminary solution (Y-1) and low-molecular weight polymer (L-2) solution were blended under reflux, followed by distilling-off of the organic solvent to recover a resin, which was then cooled and, after being solidified, pulverized to obtain a resin composition (I). The resin composition (I) showed a THF-insoluble content below 3 wt. %.

As a result of the measurement, the resin composition (I) showed peaks at molecular weights of 7500 (main peak) and $9\times10^5$, Mw/Mn=45.7 and Tg=57° C.

Further, when flakes of the resin composition were observed by a video microscope (available from Wilson Co.), a good dispersion state free from re-agglomeration (white turbid portion) was confirmed.

[Production Example 2 for resin composition]

Synthesis of low-molecular weight polymer (L-3)

400 wt. parts of the above-prepared solution of low-molecular weight polymer (L-1) was placed in a four-necked flask and the system was sufficiently aerated with nitrogen under stirring, followed by heating to a xylene reflux temperature.

While the reflux state was retained at that temperature, a mixture liquid of 4.2 wt. parts of styrene, 0.8 wt. parts of n-butyl acrylate and 2 wt. parts of 1,1-bis(tert-butylperoxy)-3,3,5 -trimethylcyclohexane was added dropwise in 4 hours, followed by holding for 1 hour to complete the polymerization, thereby obtaining a solution of low-molecular weight polymer (L-3).

A part of the polymer solution was sampled and dried under a reduced pressure to recover a low-molecular weight polymer (L-3) which, on analysis, showed Mw=8,300, Mn=4,100, PMW=6,900, Tg=58° C., and a branching index g'=0.95. The polymerization conversion was 98%.

Production of Binder resin

Similarly as in the above Production Example 1, the preliminary solution (Y-1) was prepared and then 290 wt. parts of the solution of low-molecular weight polymer (L-3) was blended therewith under reflux, followed by distilling-off of the solvent to recover a resin, which was then cooled and, after being solidified, pulverized to obtain a resin composition (II), which showed a THF-insoluble content of below 3 wt. %.

As a result of measurement of the molecular weight distribution, the resin composition (II) showed peaks at molecular weights of 7,500 (main peak) and $8.8\times10^5$, and an Mw/Mn ratio of 44.9. Tg was 58° C.

[Production Example 3 for resin composition]

Synthesis of low-molecular weight polymer (L-4)

400 wt. parts of the above-prepared solution of low-molecular weight polymer (L-1) was placed in a four-necked flask and the system was sufficiently aerated with nitrogen under stirring, followed by heating to a xylene reflux temperature.

While the reflux state was retained at that temperature, a mixture liquid of 44 wt. parts of styrene, 6 wt. parts of n-butyl acrylate and 2 wt. parts of 1,1-bis(tert-butylperoxy)-3,3,5-trimethylcyclohexane was added dropwise in 4 hours, followed by holding for 1 hour to complete the polymerization, thereby obtaining a solution of low-molecular weight polymer (L-4).

A part of the polymer solution was sampled and dried under a reduced pressure to recover a low-molecular weight polymer (L-4) which, on analysis, showed Mw=8,400, Mn=4,100, PMW=6,900, Tg=56° C., and a branching index g'=0.89. The polymerization conversion was 98%.

Production of Binder resin

Similarly as in the above Production Example 1, the preliminary solution (Y-1) was prepared and then 225 wt. parts of the solution of low-molecular weight polymer (L-4) was blended therewith under reflux, followed by distilling-off of the solvent to recover a resin, which was then cooled and, after being solidified, pulverized to obtain a resin composition (III), which showed a THF-insoluble content of below 3 wt. %.

As a result of measurement of the molecular weight distribution, the resin composition (III) showed peaks at molecular weights of 7,400 (main peak) and $8.8\times10^5$, and an Mw/Mn ratio of 45.2. Tg was 56° C.

[Production Example 4 for resin composition]

Synthesis of high-molecular weight polymer (H-2)

In a four-necked flask, 180 wt. parts of degassed water and 20 wt. parts of 2 wt. % polyvinyl alcohol aqueous solution were placed, and then a mixture liquid of 77 wt. parts of styrene, 23 wt. parts of n-butyl acrylate, 0.001 wt. part of divinylbenzene and 0.1 wt. part of 1-bis(tert-butylperoxy)-3,3,5-trimethylcyclohexane (a 10 hour-halflife temperature ($T_{10h}$)=90° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

The resultant high-molecular weight polymer (H-2) was filtered out, washed with water, dried and, as a result of measurement, showed Mw=$1.5\times10^6$, Mn=$1.2\times10^5$, PWM=$7.5\times10^5$, Tg=60° C., a THF-insoluble content of 1.0% (substantially negligible), and a branching index g'=1.15.

Production of binder resin

In a four-necked flask, 100 wt. parts of xylene, 25 wt. parts of the above high-molecular weight polymer (H-2), 3 wt. parts of low-molecular weight polyethylene (Mw=800) and 7 wt. parts of higher fatty acid represented by the formula of $CH_3(CH_2)_{48}COOH$ were placed and heated and stirred under reflux to effect preliminary dissolution. The system was retained for 12 hours in the state to obtain a preliminary solution (Y-2) wherein the polymer (H-2) and the low-molecular weight polyethylene and the higher fatty acid were uniformly mixed.

The solid matter in the preliminary solution showed Tg=55° C.

The above preliminary solution (Y-2) and 260 wt. parts of the low-molecular weight polymer (L-2) solution were blended under reflux, followed by distilling-off of the organic solvent to recover a resin, which was then cooled and, after being solidified, pulverized to obtain a resin composition (IV). The resin composition (IV) showed a THF-insoluble content below 3 wt. %.

As a result of the measurement, the resin composition (IV) showed peaks at molecular weights of 7800 (main peak) and $6.9\times10^5$, Mw/Mn=39.2 and Tg=56° C.

[Production Example 5 for resin composition]

Production of binder resin

In a four-necked flask, 100 wt. parts of xylene, 25 wt. parts of the above high-molecular weight polymer (H-2) and 7 wt. parts of low-molecular weight polypropylene (Mw=800) were placed, heated and stirred under reflux to effect preliminary dissolution. The system was retained for 12 hours in this state to obtain a preliminary solution (Y-3) of the high-molecular weight polymer (H-2) and the low-molecular weight polypropylene.

The solid matter in the preliminary solution showed Tg=59° C.

The above preliminary solution (Y-3) and 260 wt. parts of the low-molecular weight polymer (L-2) solution were blended under reflux, followed by distilling-off of the solvent to recover a resin which was then stretched under cooling, solidified and pulverized to obtain a resin composition (V). The THF-insoluble content was below 3 wt. %.

As a result of the measurement, the resin composition (V) showed peaks at molecular weights of 7,800 (main peak) and $8.9\times10^5$, Mw/Mn=46.0, and Tg=58° C.

[Comparative Production Example 1 for resin composition]

Synthesis of high molecular weight polymer (H-3)

In a four-necked flask, 180 wt. parts of degassed water and 20 wt. parts of 2 wt. % polyvinyl alcohol aqueous solution were placed, and then a mixture liquid of 77 wt. parts of styrene, 23 wt. parts of n-butyl acrylate, and 0.1 wt. part of 1-bis(tert-butylperoxy)-3,3,5-trimethylcyclohexane ($T_{10h}$=90° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was post-added, and the system was further held at the temperature for 12 hours to complete the polymerization.

The resultant high-molecular weight (H-3) was filtered out, washed with water, dried and, as a result of measurement, showed Mw=$9.6\times10^5$, Mn=$5\times10^4$, PMW=$6.0\times10^5$, Tg=60° C., a THF-insoluble content of 0.5% (substantially negligible) and a branching index g'=1.04.

Production of binder resin

In a four-necked flask, 100 wt. parts of xylene, 75 wt. parts of the above low-molecular weight polymer (L-1) (g'=1.05), 25 wt. parts of the above high-molecular weight polymer (H-3) and 7 wt. parts of low-molecular weight polyethylene (Mw=1,500) were placed, heated and stirred under reflux, followed by distilling-off of the solvent to recover a resin which was then stretched under cooling, solidified and pulverized to obtain a comparative resin composition (i).

As a result of the measurement, the comparative resin composition (i) showed peaks at molecular weights of 7,500 (main peak) and $3.9\times10^5$, Mw/Mn=27.9, and Tg=55° C.

[Comparative Production Example 2 for resin composition]

Synthesis of low-molecular weight polymer (L-5)

300 wt. parts of xylene was placed in a four-necked flask, and the system in the flask was sufficiently aerated with nitrogen under stirring, sealed and heated to a xylene reflux temperature.

While the system was held under a heat-refluxing state at the temperature, a mixture liquid of 88 wt. parts of styrene, 12 wt. parts of n-butyl acrylate, 0.01 wt. part of divinylbenzene and 7 wt. parts of di-tert-butyl peroxide was added dropwise in 2 hours, followed by holding for 1 hour to complete the polymerization thereby obtaining a solution of low-molecular weight polymer (L-5).

A part of the polymer solution was sampled and dried under a reduced pressure to recover a low-molecular weight polymer (L-5) which, on analysis, showed Mw=8,600, Mn=4,300, PMW=7,200, Tg=64° C. and a branching index g'=1.52. The polymerization conversion was 94%.

Production of Binder resin

Similarly as in the above Production Example 1, the preliminary solution (Y-2) was prepared and then 290 wt. parts of the solution of low-molecular weight polymer (L-3) (g'=1.52) was blended therewith under reflux, followed by distilling-off of the solvent to recover a resin, which was then cooled and, after being solidified, pulverized to obtain a comparative resin composition (ii).

As a result of measurement of the molecular weight distribution, the comparative resin composition (ii) showed peaks at molecular weights of 7,500 (main peak) and $8.5\times10^5$, and an Mw/Mn ratio of 50.6. Tg was 60° C.

When flakes of the resin composition were observed through a video-microscope, re-agglomerates (white turbid portions) were observed.

[Toner Production Examples 1–5 and Comparative Examples 1 and 2]

The resin compositions (I)–(V) prepared in the above Production Examples and the comparative resin compositions (i) and (ii) prepared in the Comparative Production Examples each in an amount of 100 wt. parts were respectively uniformly blended with 100 wt. parts of magnetic material fine powder and 2 wt. parts of a negative charge control agent (azo dye-based iron complex, the above-mentioned Complex [I]-7), and each blend was melt-kneaded through a twin-screw extruder (L/D=29.5, wherein L=length of total kneading zone and D=axial diameter) heated at 110° C. The kneaded products were cooled, coarsely crushed by a hammer mill and finely pulverized by a jet mill. The pulverized products were classified pneumatically to obtain magnetic toners and comparative magnetic toners each having a weight-average particle size of 6.4 $\mu$m.

Each magnetic toner in an amount of 100 wt. parts was dry-blended with 1.2 wt. parts of hydrophobic silica fine powder (BET specific surface area ($S_{BET}$)=200 $m^2/g$) treated with silicone oil. Thus, magnetic toners (A)–(E) and comparative magnetic toners (a) and (b) were prepared.

[Toner Production Example 6 and Comparative Example 3]

The resin composition (I) and the comparative resin composition (ii) each in an amount of 100 wt. parts were respectively blended with 5 wt. parts of carbon black ($S_{BET}$=130 $m^2/g$) and 3 wt. parts of an azo dye-based iron complex, Complex [II]-1), and each blend was melt-kneaded through a single screw extruder (L/D=33.7), followed by the same steps as in Toner Production Examples 1–5, whereby a non-magnetic toner and a comparative non-magnetic toner each having a weight average particle size of 6.2 $\mu$m were prepared.

These non-magnetic toners each in an amount of 100 wt. parts were respectively dry-blended with 1.5 wt. parts of hydrophobic titanium oxide fine particles ($S_{BET}$=150 $m^2/g$) to obtain a non-magnetic toner (F) and a comparative non-magnetic toner (c).

The measured molecular weight distribution and branching index g' of a low-molecular weight fraction of the respective toners thus obtained are shown in Table 1 below.

Incidentally, the resin composition of each toner showed a THF-insoluble content of less than 3 wt. %.

TABLE 1

| | Toner Properties | | | | |
|---|---|---|---|---|---|
| | Toner | $P_1MW$ | $P_2MW$ | Mw/Mn | g' |
| Ex. 1 | (A) | 7400 | $8.6 \times 10^5$ | 50.5 | 0.87 |
| Ex. 2 | (B) | 7400 | $8.3 \times 10^5$ | 49.1 | 0.96 |
| Ex. 3 | (C) | 7300 | $8.3 \times 10^5$ | 49.3 | 0.91 |
| Ex. 4 | (D) | 7400 | $6.5 \times 10^5$ | 45.7 | 0.89 |
| Ex. 5 | (E) | 7400 | $8.4 \times 10^5$ | 49.2 | 0.88 |
| Comp. Ex. 1 | (a) | 7400 | $3.0 \times 10^5$ | 21.4 | 1.02 |
| Comp. Ex. 2 | (b) | 7600 | $8.2 \times 10^5$ | 50.3 | 1.60 |
| Ex. 6 | (F) | 7400 | $9.1 \times 10^5$ | 50.9 | 0.86 |
| Comp. Ex. 3 | (c) | 7600 | $9.0 \times 10^5$ | 50.2 | 1.55 |

$P_1MW$: Peak molecular weight in a low-molecular weight region.
$P_2MW$: Peak molecular weight in a high-molecular region.
g': Branching index of a polymer fraction in a molecular weight region of at most $5 \times 10^4$.

The above-prepared toners were evaluated in an image forming apparatus having structures as illustrated in FIGS. 1–3 (a commercial laser beam printer "LBP-PXt", available from Canon K.K.) based on a reversal development scheme wherein a negatively charged latent image on a photosensitive member is developed with a negatively charged toner, under the following conditions.

FIG. 1 is a schematic sectional illustration of the laser beam printer and FIGS. 2 and 3 are illustrations of the fixing apparatus included therein.

Referring to these figures, an OPC photosensitive drum (diameter=24 mm) is rotated in a clockwise direction and is uniformly charged by a charging roller 11 to provide a dark-part potential ($V_D$) of −600 volts. Then, the drum 10 is exposed imagewise by an exposure apparatus 14 to form an electrostatic latent image having a light-part potential (Vl) of −150 volts. At the developing station, the photosensitive drum 10 and a developer-carrying member 16 (enclosing a magnet 17) is disposed with a gap of 300 μm therebetween so that the developer layer on the member 16 does not contact the photosensitive member 10. In this state, an AC bias (f=1800 Hz and Vpp=1200 V) and a DC bias ($V_{DC}$=−400 V) are applied in superposition to the developer-carrying member 16, whereby the latent image on the photosensitive member is developed with a negatively charged toner to form a toner image on the photosensitive drum 10. The thus-formed toner image is transferred onto a transfer material P, and a residual portion of the toner on the photosensitive drum is removed by a cleaner 13. On the other hand, the transfer material P separated from the photosensitive drum 10 is sent to a heat-fixing apparatus where the transfer material P is supplied with heat and pressure to fix the toner image. In this instance, the surface temperature detected by a sensor element 21*d* of a heating member 21 in the fixing apparatus H is set to 130° C., and a total pressure of 6 kg is exerted between the heating member 21 and a pressing roller 23 with a nip of 3 mm between the pressing roller 23 and a fixing film 22 held in a tension-free state. The fixing film 22 comprises a 50 μm-thick heat-resistant polyimide film coated, on its side contacting the transfer material P, with a low-resistivity release layer comprising PTFE with an electroconductive substance dispersed therein.

In case of using a non-magnetic toner, the toner is applied onto the developer-carrying member 16 by a sponge-made applicator roller disposed within the developer vessel 15 to contact the developer-carrying member 16.

By using the above-mentioned image forming apparatus, each toner (Example or Comparative) was evaluated by a print-out test for 10,000 A4-sheets continuously supplied at a rate of 4 sheets/min. while replenishing the toner as required in an environment of normal temperature/normal humidity (20° C./60% RH) and an environment of high temperature/high humidity (30° C./80% RH).

The printed images were evaluated with respect to the following items according to the respectively indicated standards. The fixing performance of the toner was also evaluated. Further, each toner was evaluated with respect to the matching with the image forming apparatus used in the manner described below. The results are shown in Tables 2 and 3.

Printed-out image evaluation (Table 2)

(1) Image density

The density of an image formed on an ordinary plain paper for copying machine (75 g/m$^2$) after printing 3000 sheets was evaluated by a MacBeth Reflection Densitometer (available from MacBeth Co.) as a relative density against a density of 0.00 allotted to a printed white background portion, and the results are evaluated according to the following standards.

◎ (excellent): 1.40 or above

○ (good): at least 1.35 and below 1.40

Δ (fair): at least 1.00 and below 1-35 x (not acceptable): below 1.00

(2) Dot reproducibility

Figure 4:
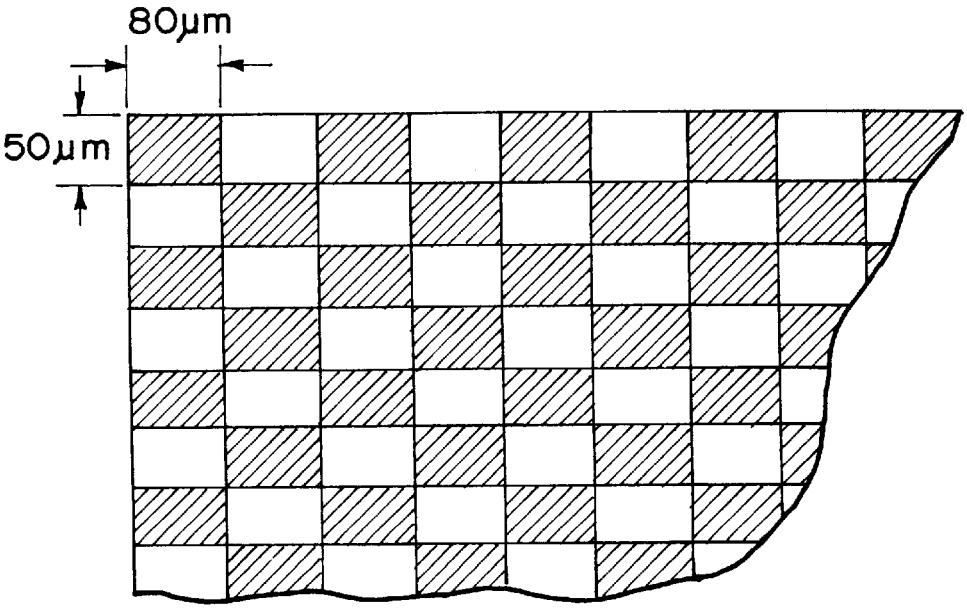
FIG. 4 is a partial illustration of a checker pattern for evaluating the developing performance of a toner.

A checker pattern shown in FIG. 4 was printed out and the dot reproducibility was evaluated by counting the number of lacked dots. The results were evaluated according to the following standards:

◎ (very good): lack of 2 dots or less/100 dots

○ (good): lack of 3–5 dots/l00 dots

Δ (practically acceptable): lack of 6–10 dots/100 dots x (practically unacceptable): lack of 11 dots or more/100 dots (3) Image fog Image fog (%) was evaluated as a difference between the whiteness of a white background portion of a printed image and the whiteness of an original transfer paper by measurement with "Reflectometer" (available from Tokyo Denshoku K.K.). The results are indicated according to the following standards:

◎ (very good): below 1.5%

○ (good): at least 1.5% and below 2.5%

Δ (practically acceptable): at least 2.5% and below 4.0% x (practically unacceptable): at least 4%

(4) Fixability

A fixed image was rubbed with a soft tissue paper under a load of 50 g/cm$^2$, and the fixability was evaluated by a lowering (%) in image density after the rubbing. The results were evaluated according to the following standards.

◎ (excellent): 5% or below

○ (good): at least 5% and below 10%

Δ (fair): at least 10% and below 20% x (not acceptable): at least 20%

(5) Anti-offset characteristic

A sample image having an image percentage of about 5% was printed out, and the anti-offset characteristic was evaluated by the degree of soiling on the image after printing of 3000 sheets. The results were evaluated by the following standards.

◎: Very good (non-observable)

○: Good (substantially non-observable)

Δ: Practically acceptable x: Practically unacceptable (6) Fixable temperature range The fixable temperature range (from a fixation initiation temperature to an uppermost temperature obviating a high temperature-offset) of each toner was evaluated by changing the temperature of the heating member 21 in the fixing apparatus H (FIG. 3) successively at an increment of 5° C. each.

Evaluation of matching with image forming apparatus (Table 3)

(1) Matching with developing sleeve

After the printing test, the state of residual toner sticking onto the developing sleeve surface and the influence thereof on the printed images were evaluated by observation with eyes. The results were evaluated according to the following standards.

◎: Very good (not observable)

○: Good (substantially non-observable)

Δ: Practically acceptable (sticking was observed but did not affect the images)

x: Practically unacceptable (much sticking was observed and resultant in image irregularity)

(2) Matching with photosensitive drum

Similarly, the occurrence of scars and residual toner on the photosensitive drum surface and the influence thereof on the printed images were evaluated by observation with eyes.

◎: Very good (non-observable)

○: Good (the occurrence of slight scar was observable but did not affect the images)

Δ: Practically acceptable (sticking and scars were observed but little affected the images)

x: Practically unacceptable (much sticking was observed and caused streak-like image irregularity)

The fixing film surface was observed and the durability thereof was evaluated.

(3) Matching with fixing apparatus (i) Surface state

The occurrence of scars or abrasion on the fixing film after the printing test was observed and evaluated with eyes according to the following standards.

◎: Very good (non-observable)

○: Good (substantially non-observable)

Δ: Practically acceptable x: Practically unacceptable (ii) Sticking of residual toner Sticking of residual toner on the fixing film after the printing test was observed with eyes and evaluated according to the following standards.

◎: Very good (non-observable)

○: Good (substantially non-observable)

Δ: Practically acceptable x: Practically unacceptable

The results of the above evaluation are summarized in the following Tables 2 and 3.

TABLE 2

| | | | Printed image evaluation | | | | | |
|---|---|---|---|---|---|---|---|---|
| Example | Toner | Resin composition | Image density | Dot reproducibility | Image fog | Fixability | Anti-offset | Fixable temp. range (° C.) |
| Ex. | | | | | | | | |
| 1 | (A) | (I) | ◎ | ◎ | ◎ | ◎ | ◎ | 110–200 |
| 2 | (B) | (II) | ◎ | ◎ | ○ | ◎ | ○ | 110–195 |
| 3 | (C) | (III) | ◎ | ○ | ◎ | ○ | ◎ | 115–200 |
| 4 | (D) | (IV) | ◎ | ○ | ○ | ◎ | ○ | 110–195 |
| 5 | (E) | (V) | Δ | Δ | Δ | ○ | Δ | 115–190 |
| Comp. Ex. | | | | | | | | |
| 1 | (a) | (i) | Δ | x | Δ | ○ | x | 120–160 |
| 2 | (b) | (ii) | ○ | x | x | x | Δ | 140–190 |
| Ex. 6 | (F) | (II) | ○ | Δ | Δ | ◎ | ○ | 110–205 |
| Comp. Ex. 3 | (c) | (ii) | Δ | Δ | x | Δ | x | 130–160 |

TABLE 3

| | | | Matching with image forming apparatus | | | |
|---|---|---|---|---|---|---|
| | | | | Photosensitive | Fixing film | |
| Example | Toner | Resin composition | Developing sleeve Surface state | drum Surface state | Surface state | Residual toner sticking |
| Ex. | | | | | | |
| 1 | (A) | (I) | ◎ | ◎ | ◎ | ◎ |
| 2 | (B) | (II) | ◎ | ○ | ◎ | ○ |

TABLE 3-continued

| | | | Matching with image forming apparatus | | | |
|---|---|---|---|---|---|---|
| | | | | Photosensitive | Fixing film | |
| Example | Toner | Resin composition | Developing sleeve Surface state | drum Surface state | Surface state | Residual toner sticking |
| 3 | (C) | (III) | ○ | ◎ | ○ | ○ |
| 4 | (D) | (IV) | ○ | ○ | ○ | ○ |
| 5 | (E) | (V) | Δ | ○ | ○ | ○ |
| Comp. Ex. | | | | | | |
| 1 | (a) | (i) | x | Δ | ○ | x |
| 2 | (b) | (ii) | Δ | x | x | Δ |
| Ex. 6 | (F) | (II) | ○ | ◎ | ◎ | ◎ |
| Comp. Ex. 3 | (c) | (ii) | x | x | Δ | x |

What is claimed is:

1. A toner for developing an electrostatic image, comprising a composition containing (i) 100 wt. parts of a binder resin component, (ii) 20–200 wt. parts of a magnetic colorant or 0.1–20 wt. parts of a non-magnetic colorant, and (iii) 1–20 wt. parts of a low molecular weight wax, wherein (a) the binder resin component has a tetrahydrofuran (THF)-insoluble content of at most 5 wt. %, (b) the binder resin component contains a THF-soluble low-molecular weight component having a molecular weight of at most $5\times10^4$ and a branching index g' of at most 0.97, (c) the THF-soluble low-molecular weight component comprises a branched styrene copolymer, (d) the binder resin component has a ratio (Mw/Mn) between weight-average molecular weight (Mw) and number-average molecular weight (Mn) of greater than 30, the binder resin component has a glass transition temperature of 50–70° C. and (f) the binder resin component contains the low-molecular weight Polymer component providing a main peak in a molecular weight region of $2\times10^3$–$3\times10^4$ and a high-molecular weight component providing a sub-peak or shoulder in a molecular weight region exceeding $5\times10^4$, respectively, on a molecular weight distribution based on gel permeation chromatography (GPC) of tetrahydrofuran (THF)-soluble component of the binder resin component.

2. The toner according to claim 1, wherein the low-molecular weight polymer component has a branching index g' of at most 0.95.

3. The toner according to claim 2, wherein the low-molecular weight polymer component has a branching index g' of at most 0.93.

4. The toner according to claim 1, wherein the binder resin component has a THF-insoluble content of at most 3 wt. %.

5. The toner according to claim 1, wherein the THF-soluble component of the binder resin component provides a sub-peak in a molecular weight region of at least $2\times10^5$.

6. The toner according to claim 5, wherein the THF-soluble component of the binder resin component provides a sub-peak in a molecular weight region of at least $3\times10^5$.

7. The toner according to claim 1, wherein the THF-soluble component of the binder resin component has a Mw/Mn ratio of at least 35.

8. The toner according to claim 1, wherein the low-molecular weight wax is a compound selected from the group consisting of polypropylene, polyethylene, microcrystalline wax, carnauba wax, sasol wax, paraffin wax, and oxidized products and graft-modified products thereof.

9. The toner according to claim 1, wherein the low-molecular weight wax has a weight-average molecular weight (Mw) of at most $3\times10^4$.

10. The toner according to claim 1, wherein the low-molecular weight wax has an Mw of at most $1\times10^4$.

11. The toner according to claim 1, wherein the low-molecular weight wax contains at least 60 wt. % of a compound represented by a formula: R-Y, wherein R denotes a hydrocarbon group having a weight-average molecular weight of at most $3\times10^3$ by gel permeation chromatography, and Y denotes hydroxyl group, carboxyl group, alkyl ether group, ester group or sulfonyl group.

12. The toner according to claim 1, wherein the low-molecular weight wax contains at least 70 wt. % of the compound.

13. The toner according to claim 1, wherein the compound has an Mn of 200–2000, an Mw of 400–3000, and an Mw/Mn ratio of at most 3.0.

14. The toner according to claim 1, wherein the composition contains 40–150 wt. parts of a magnetic material per 100 wt. parts of the binder resin component.

15. The toner according to claim 6, wherein the composition contains a charge control agent.

16. The toner according to claim 15, wherein the charge control agent is contained in 0.1–5 wt. parts per 100 wt. parts of the binder resin component.

17. The toner according to claim 15, wherein the charge control agent is a metal complex of a member selected from the group consisting of salicylic acid, naphthoic acid and derivatives thereof.

18. The toner according to claim 1, wherein the low-molecular weight polymer component comprises styrene-acrylic copolymer.

19. The toner according to claim 1, wherein the low-molecular weight polymer component comprises styrene-methacrylic copolymer.

20. The toner according to claim 1, wherein the low-molecular weight polymer component has a branching index g' of at most 0.96.

21. The toner according to claim 1, wherein the low-molecular weight polymer component has been formed by polymerizing a second monomer in mixture with a styrene copolymer as a prepolymer in the presence of a polymerization initiator comprising a peroxide having a functional group of the formula:

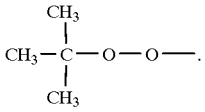

22. The toner according to claim 1, wherein the high-molecular weight polymer component has been formed by polymerization in the presence of a polyfunctional polymerization initiator.

23. The toner according to claim 1, wherein the low-molecular weight polymer component has been formed by polymerizing a second monomer in mixture with a styrene copolymer as a prepolymer in the presence of a polymerization initiator comprising a peroxide having a functional group of the formula:

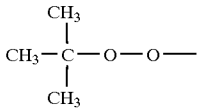

and the high molecular weight polymer component has been obtained by polymerization in the presence of a polyfunctional polymerization initiator.

* * * * *

UNITED STATES PATENT AND TRADEMARK OFFICE

CERTIFICATE OF CORRECTION

PATENT NO. : 5,962,176

DATED : October 5, 1999

INVENTOR(S) : MANABU OHNO ET AL.

It is certified that error appears in the above-identified patent and that said Letters Patent is hereby corrected as shown below:

ON THE TITLE PAGE [56] References Cited:

OTHER PUBLICATIONS, ""Size-Exclsusion" should read --"Size Exclusion--.

COLUMN 3:

Line 36, "more" should be deleted; and
Line 37, "required" should read --required more--.

COLUMN 6:

Line 44,
"$g'(M)=[\eta_{branch}](M)/[\eta_{linear}](M)=[\eta_{branch}](M)/K_{linearr} \times M^{\alpha linear}$,"
should read
--"$g'(M)=[\eta_{branch}](M)/[\eta_{linear}](M)=[\eta_{branch}](M)/K_{linear} \times M^{\alpha linear}$,"--.

COLUMN 13:

Line 1, "include:." should read --include:--; and
Line 2, "alkalline" should read --alkaline--.

COLUMN 16:

Line 63, "there acids." should read --these acids.--

UNITED STATES PATENT AND TRADEMARK OFFICE

CERTIFICATE OF CORRECTION

PATENT NO. : 5,962,176

DATED : October 5, 1999

INVENTOR(S) : MANABU OHNO ET AL.

It is certified that error appears in the above-identified patent and that said Letters Patent is hereby corrected as shown below:

COLUMN 17:

Line 27

" 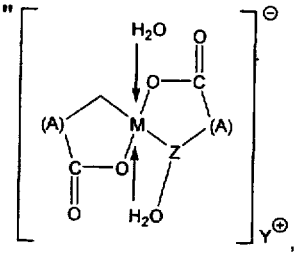 " should read -- 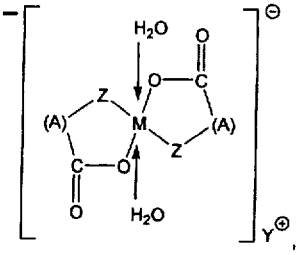 --.

COLUMN 21:

Line 1,

" 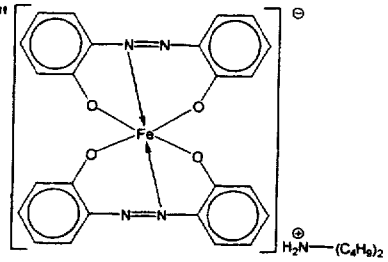 " should read -- 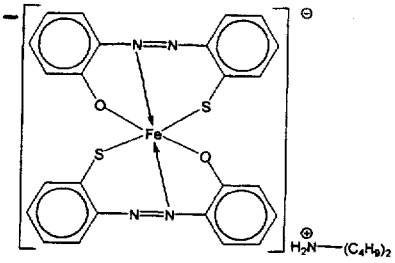 --.

COLUMN 26:

Line 66, "50-400 m2/g," should read --50-400 $m^2/g$,--.

UNITED STATES PATENT AND TRADEMARK OFFICE

CERTIFICATE OF CORRECTION

PATENT NO. : 5,962,176

DATED : October 5, 1999

INVENTOR(S) : MANABU OHNO ET AL.

It is certified that error appears in the above-identified patent and that said Letters Patent is hereby corrected as shown below:

COLUMN 34:

Line 15, "(L-3)" should read --(L-5)--.

COLUMN 35:

Line 25, ""LBP-PXt"," should read --"LBP-PX",--; and
Line 44, "$V_{DC}$=-"should read --($V_{DC}$=--; and
Line 45, "400V)" should read -- -400V)--.

COLUMN 36:

Line 28, "1-35" should read --1.35--.

COLUMN 39:

Line 43, "Polymer" should read --polymer--.

Signed and Sealed this

Twenty-fifth Day of July, 2000

*Attest:*

Q. TODD DICKINSON

*Attesting Officer*

*Director of Patents and Trademarks*